United States Patent [19]

Bain et al.

[11] Patent Number: 4,849,025

[45] Date of Patent: Jul. 18, 1989

[54] DECOKING HYDROCARBON REACTORS BY WET OXIDATION

[75] Inventors: Richard L. Bain, Golden; John R. Larson, Boulder, both of Colo.

[73] Assignee: Resource Technology Associates, Boulder, Colo.

[21] Appl. No.: 58,513

[22] Filed: Jun. 5, 1987

[51] Int. Cl.[4] ..... B08B 9/00

[52] U.S. Cl. ..... 134/22.1; 134/28; 134/29; 134/41

[58] Field of Search ..... 134/7, 8, 28, 29, 41, 134/221; 422/187, 207

[56] References Cited

U.S. PATENT DOCUMENTS 4,127,473 11/1978 Hozuma ..... 422/129
4,196,050 4/1980 Takahashi et al. ..... 134/22.1
4,203,778 5/1980 Nunciato et al. ..... 134/7
4,226,640 10/1980 Berthodlt ..... 134/7
4,243,633 1/1981 Hozuma ..... 422/129

*Primary Examiner*—H. M. S. Sneed
*Assistant Examiner*—Sharon T. Cohen
*Attorney, Agent, or Firm*—Sheridan, Ross & McIntosh

[57] ABSTRACT

A method is disclosed for decoking a vertical tube reactor. The decoking process involves contacting the coke with an oxidizing substance in the presence of a carrier liquid to oxidize the coke and produce carbon dioxide, water and by-products. The post-oxidation temperature is maintained below the critical temperature of the carrier liquid at the local pressure. The conditions of the coke oxidation are maintained in such a manner as to assure that the by-products are substantially suspended or dissolved in the liquid.

28 Claims, 2 Drawing Sheets

DECOKING HYDROCARBON REACTORS BY WET OXIDATION

FIELD OF THE INVENTION

The present invention relates to the decoking of reactors used in treatment of hydrocarbons by oxidizing the coke deposits in the presence of liquid and more particularly, to the oxidative decoking of the interior of a vertical tube reactor used in processing petroleum feedstocks.

BACKGROUND OF THE INVENTION

Many of the processes used for the treatment of hydrocarbons result in the formation of coke deposits on surfaces of the treatment vessel or reactor. Such processes include petroleum cracking such as thermal cracking or hydrocracking, visbreaking, refining, and upgrading. As described in commonly assigned pending U.S. patent application Ser. No. 771,205, filed Aug. 30, 1985, and in commonly assigned U.S. Pat. No. 4,648,964 of Leto et al. (1987), one type of apparatus which can be used in one or more of the above processes is a vertical tube reactor, i.e. a reactor which uses pressure obtained from the hydrostatic head of a column of fluid above the reaction zone. When high pressures are desired for the reaction zone, a large vertical extent is needed to develop the necessary hydrostatic pressure. In these cases, the vertical tube reactor can be disposed underground, such as in a well bore.

Deposition of coke in such a reactor is particularly troublesome because the difficulty of access renders conventional processes for removal of coke deposits especially burdensome. Removal of coke deposits is desirable because the coke inhibits heat transfer across the walls of the reactor vessel thus making heat exchange methods inefficient, decreases reactor volume, and can build up to such a degree that fluid flow through the reactor is inhibited or blocked.

A mechanical apparatus to physically dislodge or scrub coke particles has been employed in some reactors. U.S. Pat. No. 4,196,050 (1980) of Takahashi et al. describes a rotatable injection pipe for introduction of a scrubbing liquid with means for reciprocating motion. Such insertable devices are of limited value when the reactor is relatively inaccessible, such as in the case of a subterranean vertical tube reactor.

Other methods have relied on oxidation of the coke to remove coke deposits. U.S. Pat. No. 3,365,387 (1968) of Cahn et al. discloses decoking a thermal cracker by passing a mixture of steam and water through the reactor tubes at essentially the same temperature level as used for the thermal cracking. If water is used, it must be vaporized and super heated to about 700° F. (371° C.) prior to entering the section to be decoked. U.S. Pat. No. 3,054,700 (1962) of Martin discloses removing material from a shell and tube heat exchanger by introducing an oxygen-containing gas, possibly mixed with steam. U.S. Pat. No. 4,420,343 (1983) of Sliwka discloses thermal decoking of cracked gas coolers by introduction of a steam/air mixture. U.S. Pat. No. 4,376,694 (1983) of Lohr et al. discloses decoking surfaces of a cracking plant by admitting a steam and air gas mixture. U.S. Pat. No. 4,454,022 (1984) of Shoji et al. discloses removal of coke deposits in the gas passages of a thermal cracking apparatus by contact with a stream of oxygen-containing combustion gas.

All of these methods are impractical for use in decoking a reactor which is physically relatively inaccessible, such as a subterranean vertical tube reactor. The above methods all use a material which is in a gaseous state such as air, oxygen, or steam. In general, control of heat in the oxidation reaction has not been a major problem in above ground or otherwise physically accessible apparatus, even though such gaseous materials have a lower cooling capacity (i.e. thermal conductivity and heat capacity) than liquid phase materials. In such accessible apparatus, damage to the apparatus from overheating is avoided by external monitoring such as visually tracking the movement of the "hot spot" (the portion of the apparatus heated to relatively high, often irridescent temperatures). Visual monitoring is impractical in a subterranean or inaccessible apparatus. Use of temperature probes in a number sufficient for proper monitoring of wall temperature for a "hot spot" would be prohibitively expensive in a subterranean apparatus. Although such overheating can be controlled by reducing the rate of flow of the gaseous material, the consequent reduction in reaction rate can interfere with maintaining the minimum temperature necessary for establishing the desired reaction. Furthermore, reduction of the reaction rate increases the period during which the apparatus is off-line.

Gas phase decoking is also impractical in an inaccessible apparatus because gaseous material is inefficient for removing non-gaseous by-products and spalled coke from the reactor. If the gaseous material is used to blow out suspended by-product or spalled particulates, a relatively high flow rate is required to maintain the particles in suspension. When particle suspension becomes the determining factor with respect to gas flow rate, there is either inefficient utilization of the oxidizing reagent or an excessively long off-line period. The problem is particularly troublesome in a vertical reactor in which particulates must be not only suspended but lifted out of the reactor by the fluid flow. This difficulty is overcome in accessible reactors because any material which settles in the reactor can be manually removed, for example, by providing traps or drains. Such methods are impractical or expensive for removing material which has settled to the bottom of a subterranean or inaccessible reactor.

Some products of an oxidative decoking reaction can be corrosive depending upon the reactor materials of construction. When the decoking is accomplished using a gaseous material, the corrosive products can remain relatively concentrated or localized so that apparatus corrosion can be a significant concern. The occurrence of such corrosion is of particular concern when the reactor cannot be readily accessed for maintenance or replacement of parts.

In applications where the reactor is disposed far underground in order to achieve substantially elevated pressure, it is economically infeasible to supply steam to the reactor at the required pressure and temperature. The heat loss experienced by a long steam line would require extensive thermal insulation and/or auxiliary heating devices, either of which involves considerable expense in materials and design. In addition to heat loss experienced by an extended steam line, the high pressure developed at substantial distances below ground contributes to condensation of the steam.

U.S. Pat. No. 2,882,237 (1959) discloses that an aqueous solution of hydrogen peroxide can be used to remove carbonaceous resinous or gummy deposits, but only when the hydrogen peroxide is "activated" with ammonia. There is no suggestion in this patent of treatment at elevated pressure or the temperatures contemplated in the instant process.

Several references disclose use of an underground vertical reactor for various processes. U.S. Pat. No. 3,449,247 (1969) of Bauer discloses flowing refuse and fluid sewage in a subterranean vertical shaft to obtain the desired pressure for wet oxidation of the combustible waste materials. U.S. Pat. No. 3,464,885 (1969) of Land et al. discloses a subterranean reaction, particularly for digestion of wood chips. U.S. Pat. No. 4,272,383 (1981) of McGrew discloses a subterranean vertical reactor for accelerating chemical reactions including wet oxidation. It discloses the formation and use of Taylor Bubbles in which there is essentially plug flow of vapor phase "bubbles" in a liquid phase. It is particularly directed to the oxidation of sewage sludge.

U.S. Pat. No. 3,853,759 (1974) of Titmas discloses that adherence of materials to the apparatus walls of a subterranean vertical reactor can be deterred by providing for rotation of the tube or "liner". This process limits the oxidation reaction by restricting the process to the oxygen present in the material introduced, i.e. no additional oxygen is added. This reference does not disclose oxidation of adhered materials and thus does not recognize the problems of temperature control or precipitation of by-products discussed above.

U.S. Pat. No. 3,606,999 (1971) of Lawless discloses a vertical reactor for contacting solids, liquids and gases useful for utilizing physical, chemical, or thermal treatment under elevated pressure of continuously flowing streams which may contain suspended solids. This reference further discloses that any accumulation of sludge or fuel ash, or other insoluble materials below the reaction zone, can be removed continuously or intermittently if desired by a pump or siphon. This reference is not concerned with removing material which adheres to the reactor vessel.

These references are primarily concerned with oxidizing materials which are introduced into the reactor in an aqueous stream and the processes of these references are thus amenable to ready mixing of the oxidant and the material to be oxidized. When the oxidizable material is sewage sludge and waste streams as disclosed by McGrew, the purpose is to substantially oxidize all of the oxidizable materials. Therefore, oxygen is normally maintained in excess and the amount of sludge in the reactor is controlled. Additionally, excess heat is removed by a cooling system to increase throughput for a given reactor volume. These references provide no method for treating or reacting a material which is already in the reactor such as removing coke deposits from the walls of a reactor. These references thus do not recognize the attendant problems of thermal or corrosion damage to the reactor or accumulation of by-products. These problems are especially troublesome when the oxidant is not mixed with the material to be oxidized throughout the volume of the reaction zone, but rather the oxidation takes place substantially along the surface of a sheet of the material to be oxidized, e.g. a sheet of deposited coke. Further, the apparatus of each of these patents is intended to maintain flow of a fluid containing suspended particles as its normal mode of operation. Such apparatus is not necessarily operable in connection with a process which must maintain, under normal conditions, a flow of liquid with only minor amounts of suspended particles.

None of the known references discloses or suggests processes useful for removing deposits such as coke deposits which adhere to the surfaces of a relatively inaccessible reactor such as a vertical tube reactor disposed underground. None of the references recognizes or proposes solutions to the problems of heat damage from the exothermic oxidation of coke deposits, corrosive or acidic by-products resulting from coke oxidation, or retaining in suspension substantially insoluble coke oxidation by-products, particularly when the production mode involves treating a feed without substantial concentration of solid by-products. Therefore, there is a need to provide a method for removing coke from a hydrocarbon reactor which minimizes or eliminates the accumulation of by-products such as ash, particulates, or granules, and which minimizes or avoids thermal or corrosion damage to the reactor vessel.

SUMMARY OF THE INVENTION

According to the present invention, there is provided a method for removing coke deposited on reactor surfaces. The method involves passing an influent stream of carrier liquid at a first temperature into the reactor containing the coke deposits. A heated carrier liquid is provided by increasing its temperature from a first temperature to a second temperature. The coke is contacted with an oxidizing agent in the presence of the heated carrier liquid at a contact temperature to effect exothermic oxidation of the coke. The contacting occurs under a superatmospheric pressure greater than the vapor pressure of the carrier liquid at the contact temperature. The oxidation of the coke produces carbon dioxide, water and oxidation reaction by-products. Heat produced by the oxidation of the coke is removed from the oxidation site by flowing carrier liquid past the oxidation site to provide carrier liquid at a post-oxidation temperature. The amount of oxidizing agent is controlled to maintain the post-oxidation temperature of the carrier liquid below its critical temperature at local pressure conditions and to maintain the carrier liquid in substantially liquid phase. The carrier liquid containing the oxidation products and by-products is passed into heat exchange contact with the influent stream of carrier liquid.

In another embodiment, the instant invention involves a method for removing coke from the internal surfaces of a vertical tube reactor. An influent stream of carrier liquid is passed downwardly into the vertical tube reactor to form a hydrostatic column of fluid which provides increasing pressure on each volume segment of carrier liquid. The temperature of the carrier liquid is increased from a first temperature to a second temperature to provide a heated carrier liquid. The coke is contacted with an oxidizing agent in the presence of the heated carrier liquid at a contact temperature to effect exothermic oxidation of the coke. The contacting of the coke and oxidizing agent occurs under a superatmospheric pressure which is provided at least in part by the hydrostatic column of fluid. The superatmospheric pressure is greater than the vapor pressure of the carrier liquid at the contact temperature. The oxidation reaction produces carbon dioxide, water and oxidation by-products. Heat is removed from the oxidation site by flowing the carrier liquid past the oxidizing coke to provide the carrier liquid at a post-oxidation temperature. The amount of oxidizing agent is controlled to maintain the post-oxidation temperature less than the critical temperature of the carrier liquid at local pressure conditions and maintain the carrier liquid in substantially liquid phase. The carrier liquid containing the oxidation products and by-products is passed as an effluent upwardly into heat-exchange contact with the influent stream of carrier liquid. At least one of the influent or effluent streams is in turbulent flow.

DETAILED DESCRIPTION OF THE PREFERRED EMBODIMENT

Figure 1:
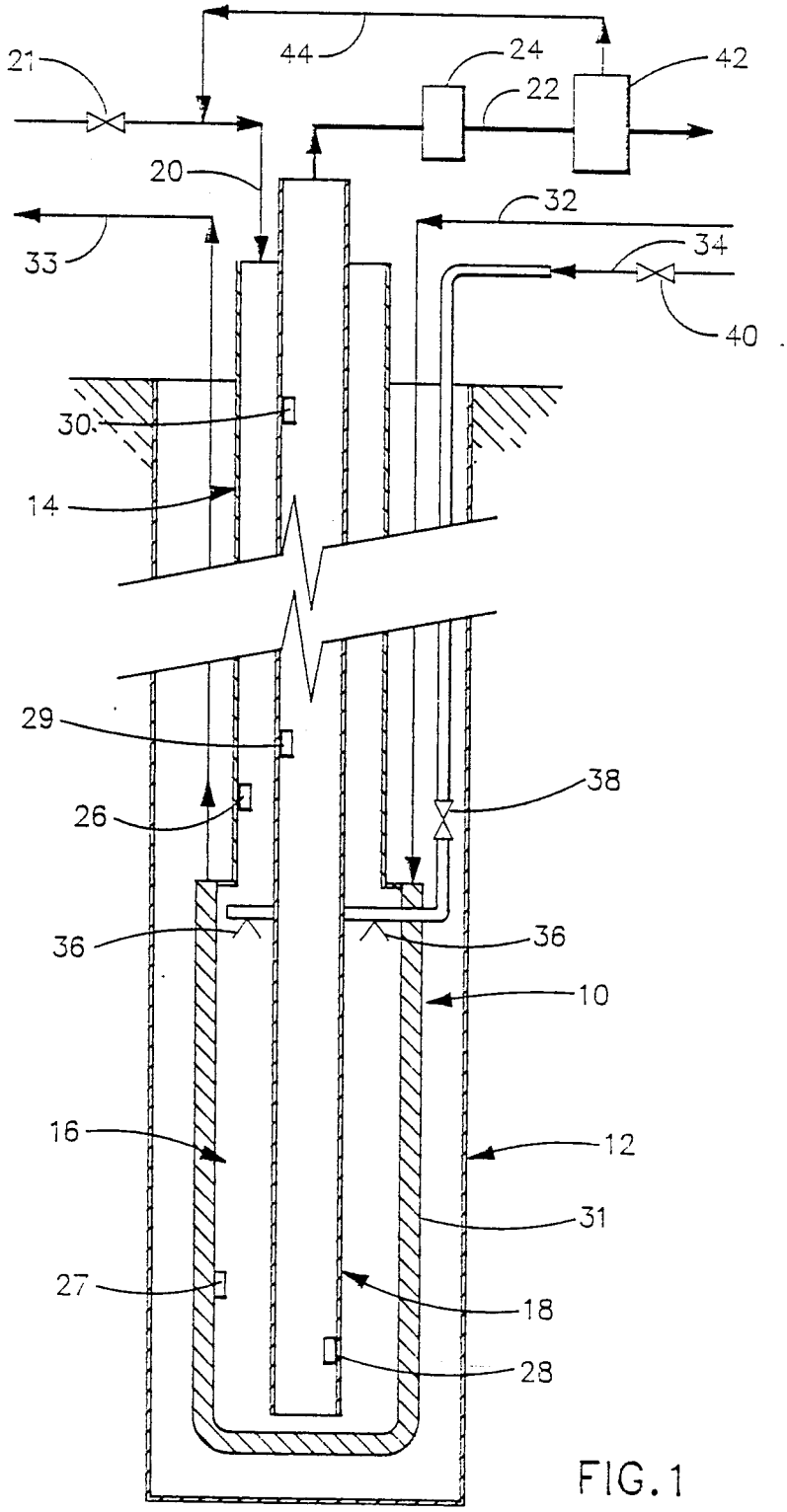
FIG. 1 is a schematic representation of a subterranean vertical tube reactor for which the practice of the process of this invention is particularly useful.

The coke removal method of the present invention involves oxidizing coke deposited on reactor surfaces while avoiding localized excessive temperatures caused by the heat evolved by the exothermic oxidation reaction. The precipitation of by-products or excessive concentrations of acidic or corrosive by-products is also avoided. As used herein, the term "coke" refers to a carbonaceous material which is insoluble in benzene and/or toluene. The coke is normally deficient in hydrogen and also commonly contains sulfur and metals, such as vanadium, nickel, and iron. According to the present invention, decoking is accomplished by contacting the coke with an oxidizing agent in the presence of a carrier liquid under conditions which maintain the carrier liquid in substantially liquid phase. The amount of oxidizing agent in the carrier liquid is controlled so that the heat evolved by the oxidation reaction does not cause hot spots on the reactor surfaces. The oxidation products and by-products are maintained in a substantially suspended or dissolved state. Sufficient pressure is maintained so that, at the oxidation site and immediately downstream from the oxidation site, the carrier liquid is substantially in its liquid state.

Oxidation of the coke produces $CO_2$, $H_2O$ and a number of by-products such as sulfates and metal compounds. It has been found that once the by-products of coke oxidation are precipitated in a solid form, redissolving the by-products can be particularly difficult. The present invention involves providing conditions for coke oxidation which result in substantial dissolution of soluble by-products. Those by-products of the decoking process which are not substantially soluble and thus remain in solid phase are maintained in suspension in the carrier liquid and are carried out of the reactor without substantial amounts settling to the bottom of the reactor or being deposited on the reactor walls.

The process of the present invention is useful whenever it is desired to perform decoking of a vessel by oxidation without significant accumulation of solid by-products and without significant thermal or corrosion damage to the apparatus. As discussed hereinabove, the present invention is particularly useful in decoking a subterranean, substantially vertical reactor. Coke deposited on the internal surfaces of such a reactor can be the result of processing any of a number of materials, particularly hydrocarbons such as a petroleum or petroleum products which contain asphaltenes. Hydrocarbon processing which results in coke deposition can include mild thermal treatment, thermal cracking, hydrocracking, visbreaking, refining and upgrading.

The oxidizing agents useful in the instant process react with the coke exothermically at an economically acceptable rate under the reaction conditions and do not produce by-products which are insoluble or nondispersible in the carrier liquid. Preferably, the oxidizing agent is a substance which can be dissolved or dispersed in the carrier liquid. More preferably, the oxidizing agent is a fluid or is soluble in the carrier liquid. Preferred oxidizing agents include oxygen or hydrogen peroxide although materials such as soluble chlorates, perchlorates, or permanganates can also be used depending upon the materials of construction of the reactor apparatus. Preferred sources of oxygen include air, enriched air and substantially pure oxygen. It is recognized that under the reaction conditions certain oxidizing agents can decompose to provide an active oxidizing agent as, for example, the formation of oxygen by hydrogen peroxide. As used herein, the term "oxidizing agent" refers to the material actually introduced into the system. It is contemplated that the process can be modified to use a solid oxidizing agent insoluble in the carrier liquid provided effective contact between the coke and oxidizing agent can be obtained through, for example, agitation and/or turbulent flow of the carrier liquid.

The carrier liquid serves to remove the heat of reaction from the oxidation reaction site and also transport oxidation products and by-products out of the reactor. The carrier liquid preferably has a sufficiently high vaporization point that it can be maintained substantially in liquid phase even after any temperature rise caused by absorbing the heat from the exothermic coke oxidation reaction, referred to herein as the "post-oxidation temperature". This can also be accomplished by maintaining the carrier liquid under a pressure greater than the vaporization pressure at the maximum temperature reached by the carrier liquid. The carrier liquid preferably has a high ability to absorb the heat of the coke oxidation reaction with sufficient rapidity that a reactor "hot spot" or substantial local vaporization of the carrier fluid is avoided. By "hot spot" is meant a localized increase of the wall temperature of at least about 50° C. as compared to the temperature of the wall prior to the oxidation reaction. The ability of the carrier liquid to absorb heat is related to its heat capacity, its thermal conductivity, and its degree of mixing at the reaction temperature and pressure. A preferred carrier liquid is water. The carrier can be a fluid at ambient temperature and pressure but should be a liquid at the decoking site and under the decoking conditions for the reasons set forth herein.

Controlling the flow rate of carrier liquid serves to control the ability of the system to absorb the heat generated by the reaction and to accommodate reaction by-products. For a given flow rate of carrier liquid, the capacity of the carrier to absorb heat depends upon a number of factors including: (a) the thermodynamic nature of the carrier, and (b) the physical state of the carrier. For any given decoking cycle, the composition and flow rate of the carrier is typically held constant and the temperature and pressure are controlled to maintain the carrier in a liquid state. If the oxidant flow rate is held constant, increasing the carrier flow rate increases the quantity per unit time of carrier which is available to absorb the heat generated by the oxidation reaction and also to dissolve or suspend the reaction by-products. This also decreases the amount of oxidizing agent per unit volume of the carrier liquid. It is preferred that the carrier liquid be in turbulent flow to more effectively carry any particulates formed out of the reactor.

The rate at which the oxidant is introduced into the carrier liquid controls the rate of coke oxidation. The rate of coke oxidation should not exceed that rate at which the heat generated from the coke oxidation is removed from the oxidation site by the carrier liquid. When the carrier liquid cannot absorb the heat from the coke oxidation with sufficient rapidity, a "hot spot" can develop on the reactor wall and can cause thermal damage to the reactor. Additionally, the carrier liquid can be locally vaporized leading to a further loss of heat absorbing capacity by the carrier liquid and causing a pressure imbalance in the reactor system. The rate of coke oxidation also should not be so rapid that the rate of oxidation by-products, particularly acidic or corrosive by-products and insoluble by-products, exceeds the capacity of the carrier liquid to accommodate the by-products by dissolution or dispersion. When the rate of formation of acidic or corrosive by-products is too rapid, the concentration of acidic or corrosive materials in the carrier liquid can become so high that corrosion damage to the reactor vessel can ensue.

The rate of oxidation should be rapid enough to be economically and practically acceptable. Since the coke removal process necessitates reactor downtime, the coke should be removed at as high a rate as is possible without reactor damage and operational difficulties. The rate of the oxidation reaction normally increases as the temperature at which the oxidant and oxidizable material are contacted increases. Consequently, the lowest useful temperature is that at which a commercially useful rate of oxidation is attained. This contact (or decoking) temperature can be readily determined by a skilled person. The preferred operation is to have the highest temperature at which the carrier can be maintained in liquid phase at the local pressure. The rate of oxidation is preferably maintained less than that which would result in a wall temperature increase of about 100° C. as compared to the temperature before the oxidation reaction commences.

The maximum rate of oxidant introduction depends upon a number of factors including: (a) the chemical nature of the by-products of coke oxidation, which in turn depends upon the chemical nature of the coke deposits as well as the reaction conditions such as temperature and pressure, (b) the location and distribution of the coke deposits, (c) the chemical nature of the oxidant used, (d) the flow rate of the carrier liquid, (e) the chemical nature of the carrier liquid, and (f) the amount of heat which is required in the system to compensate for heat losses to the environment as well as any additional heat required to increase the influent carrier liquid temperature from the heat exchange temperature to the contact temperature.

In order to avoid the problems associated with an excessive reaction rate, the flow rate of oxidant and the flow rate of carrier liquid can be controlled. Controlling the flow rate of oxidant serves to control the rate of reaction (by controlling the concentration of the oxidizing agent) and thus the rate at which heat is generated by the exothermic coke oxidation. For a given rate of oxidant flow, the rate at which heat is generated, provided coke is the only oxidizable substance present, depends upon factors including: (a) the chemical nature of the coke deposits, (b) the reaction conditions such as temperature and pressure, and (c) the particular oxidant used. For any given decoking cycle, the chemical nature of the coke deposits, the reaction pressure, and the chemical nature of the oxidant used remain relatively constant and the temperature is controlled principally by controlling the rate of oxidation. If the carrier flow rate is held constant, decreasing the oxidant flow rate decreases the rate of reaction and thus can be used to avoid the problems associated with an excessive reaction rate.

As discussed hereinabove, the rate of oxidation depends on the temperature at which the reaction occurs as well as the effective concentration of oxidizing agent at the site of the oxidation reaction. The effective concentration of oxidizing agent can depend on the mass transfer of the agent in the carrier. This can be particularly significant with gaseous or solid oxidizing agents as compared to liquid or soluble oxidizing agents. When a soluble or liquid oxidizing agent is used, it is normally convenient to introduce the agent into the carrier stream above ground. When gaseous oxidizing agents (such as oxygen) are used, it is normally preferred to add the agent to the pressurized carrier liquid to obtain increased solubility and a higher effective concentration in the carrier liquid. It is of course necessary to introduce the oxidant upstream of the coke deposits.

The temperature of the influent carrier liquid is normally increased from an initial temperature to the contact temperature. This can be accomplished by heating before introducing it into the reactor system. This has disadvantages of increased pressure at the elevated temperature and possible heat loss to the environment before contacting the coke. Preferably the influent stream is heated by contact with the effluent stream. If efficient heat transfer is obtained, the temperature of the influent stream after heat exchange (referred to herein as the "heat exchange temperature" or "second temperature") is close to or equal to the contact temperature. During the oxidation reaction, the temperature of the carrier liquid can be increased (provided there is sufficient coke) above the contact temperature to provide an elevated post-oxidation temperature which compensates for heat loss to the environment as well as allows the desired contact temperature to be achieved in the influent stream by heat exchange. Heat can be conserved by recycling effluent carrier liquid as influent carrier.

In the event that there is insufficient coke to provide this amount of heat or the coke oxidation is producing hot spots, oxidizable materials can be added to the carrier stream to provide the necessary heat. Such oxidizable materials can include organic substances such as alcohols, e.g. methanol, oils such as whole crude or distillate fractions, and the like. Heat can also be added indirectly by a heat source such as a jacket containing a heat exchange medium surrounding the reactor.

The progress of the decoking reaction can be conveniently followed by monitoring: (a) one or more reaction products or by-products particularly $CO_2$; (b) pressure of the carrier liquid; and/or (c) temperature of the carrier liquid. For example, the appearance of carbon dioxide indicates the initiation of the oxidative decoking reaction; whereas, the decrease and finally the absence of carbon dioxide indicates substantial removal of the coke deposits. The oxygen level in the off-gas after the carrier liquid has exited the system can also be monitored when oxygen or an oxygen producing oxidizing agent is used. When the process is operated so that all of the oxygen reacts with coke that is present, the appearance of oxygen indicates the absence of coke. In the early stages of decoking, a high ratio of oxidizing agent to $CO_2$ indicates that the temperature at which the oxidizing agent contracts the coke should be increased to increase the rate of oxidation reaction. Monitoring pressure increases or fluctuations is also a convenient way to determine if there is localized overheating in the system resulting in the formation of vapor phase regions.

The products and by-products of the oxidation reaction can be damaging to the internal components of the reactor. Therefore, the pH of the carrier liquid should be monitored to determine if neutralizing agents should be added. Acidic or caustic damage to the reactor vessel can be controlled by adding a neutralizing or buffering material to the carrier liquid, for example, a caustic material can be added when the coke oxidation by-products are acidic. When the rate of production of insoluble by-products exceeds the capacity of the carrier liquid to maintain the by-products in suspension, the by-products can settle to the bottom of the reactor vessel or coat internal surfaces causing a loss of reactor vessel capacity and/or heat exchange efficiency. These materials can also become entrained in the product stream after the decoking step has been terminated and the main material treatment process has restarted. Therefore, the rate of flow of the carrier stream and/or its turbulence should be sufficient to remove solids from the reactor for the particular oxidation rate.

The instant method is particularly useful in an apparatus whose main function is a high pressure heat-treatment of carbonaceous materials. The decoking reaction conditions, including the temperature and pressure, should be consistent with, and are to some extent constrained by, the temperature and pressure conditions for the treatment process which produced the coke deposition. In general, it is preferred to conduct the decoking process under conditions which can be achieved without substantially modifying or making additions to the apparatus needed for the principal material treatment processes. When a vertical tube reactor is used, the reaction vessel pressure is substantially determined by the hydrostatic head of the liquid above the reactor section. This pressure can be adjusted somewhat by changing the density of the fluid in the system or by supplying the liquid to the reactor at an elevated pressure. However, since it is difficult and expensive to provide a vertical tube reactor which can accommodate a wide variety of reaction pressures, it is preferred to conduct the decoking step at a pressure substantially similar to the pressure used during the primary material treatment process. It is important that the pressure be at least that necessary to maintain the carrier liquid in substantially liquid phase at the oxidation temperature used. In general, the decoking step according to the present invention is conducted at a pressure between about 1000 psi and about 4000 psi, more preferably between about 1000 psi and about 2500 psi. It is also desirable to conduct the decoking at a temperature which is substantially similar to the temperature used during the main material treatment process to minimize cooling and heating required in cycling between the material treatment process and decoking. Normally, the decoking step of the present invention is conducted at a temperature between about 250° C. and the critical point of the carrier liquid and a pressure in excess of the vaporization pressure of the carrier liquid at the decoking temperature used. Alternatively, it can be viewed that the temperature should be maintained below the boiling point of the carrier liquid at the pressure used. When water is used as the carrier liquid, the temperature is normally between about 250° C. and about 374° C.

Although the present process is useful in a number of different processing methods, the invention can be more readily understood after a brief description of a typical production application in the context of which decoking is particularly valuable. As will be understood by those in the art, other apparatus and configurations can be used in practice of the present invention.

FIG. 1 depicts a subterranean vertical tube reactor 10 disposed within a well bore 12. The term "vertical" is used herein to mean that the tubular reactor is disposed toward the earth's center. It is contemplated that the tubular reactor can be oriented several degrees from true vertical, i.e. normally within about 10 degrees. Flow direction during production operation can be in either direction. As depicted, flow of untreated feed is down the downcomer tube 14 to the reaction zone 16 and up the concentric riser 18. This arrangement provides for heat exchange between the outgoing and incoming streams. During production operation, i.e. before decoking, untreated feed is introduced through a feed inlet 20, the flow rate being controlled by a valve 21. Product is recovered through exit conduit 22. The reactor can be fitted with a number of monitoring devices such as a device for monitoring carbon dioxide content of the exit stream 24 or temperature and/or pressure monitors 26, 27, 28, 29 and 30. A heat source 31 can be provided, normally external to the reactor, in order to provide heat to either initiate the reaction or, when the reaction is not self-sustaining, to maintain the temperature required for reaction. Preferably it involves the use of a heat exchange medium introduced through line 32 and exiting through line 33. Pressure in the reaction zone 16 is primarily provided by the hydrostatic head of the feed and product streams. In this fashion, fluid entering through conduit 20 and proceeding downward through the downcomer 14 is subjected to a substantially continuously increasing pressure. The incoming stream is preferably at least partially heated by heat exchange with the heated product traveling upward in the riser tube 18.

To maximize the effectiveness of the heat exchange between the outgoing and incoming streams of liquid, it is preferred that turbulent flow conditions be maintained in at least one of the streams. It is preferred that both the streams be under turbulent flow conditions in order to maximize heat exchange effectiveness. A preferred method of providing turbulent flow is by establishing substantially vertical multiphase flow. This type of flow provides substantially improved heat-treatment exchange coefficients. It is desirable that this type of flow be maintained in at least the effluent stream.

One typical production application involves the introduction through conduit 20 of a crude petroleum in order to subject the crude petroleum to a pressure/temperature treatment to reduce its viscosity and render it more readily transportable. During processing, the crude petroleum introduced through conduit 20 flows down the downcomer conduit 14 and enters the reaction zone 16. The temperature of the untreated feed as it enters the reaction zone 16 is monitored by one or more thermocouples 27. The external heat source 31 is employed to raise the temperature of the petroleum. A typical treatment temperature is in the range of about 250° C. to about 450° C. The pressure in the reactor zone 16 is developed at least partially by virtue of the hydrostatic head of the column of petroleum residing in the downcomer tube 14. A typical treatment pressure is in the range of about 1000 psig (6.9 MPa) to about 4000 psig (27.6 MPa). A neutral material such as nitrogen gas is preferably introduced through input line 34 and nozzle 36. Flow rate of the gas is controlled by a valve 40. The purpose of this gas flow is to provide a positive pressure in line 34 to prevent or minimize back flow of petroleum into the line 34 during the production stage of operation. If some amount of gas-feed reaction is desired during the production stage, the line 34 and nozzle 36 can be used for introduction of a reactant gas such as oxygen. Of course, a plurality of nozzles can be used as desired.

The feed is maintained in the reaction zone 16 for a time sufficient to accomplish the desired reaction. Since the reaction occurs in a continuous flow mode, residence time in the reaction zone 16 can be adjusted by adjusting the volume of the reaction zone 16 or by changing the flow rate of the stream. The treated petroleum flows upward through riser conduit 18. Temperature in the riser conduit 18 is monitored by one or more thermocouples 29. Since deposition of coke on the walls of the riser conduit 18 affects the rate of heat transfer across conduit 18, it is possible to deduce the amount of coke deposition by determining the change in the rate of heat transfer. One method of calculating the rate of heat transfer is by comparing the temperature of the treated stream with the feed stream after the feed stream has been in heat exchange relation with the treated stream, such as by comparing the temperatures measured at thermocouples 26 and 28. Alternatively, if such method is not applicable, the decoking procedure can be routinely implemented after certain periods of operation. The treated stream is removed from the riser by conduit 22.

Having described a typical operation which can result in coke deposition, a preferred method of decoking such a reactor is now described. When it is determined that the amount of coke deposited in the vertical reactor warrants a decoking procedure or after a certain period of operation, the temperature in the reaction zone 16 is adjusted to the temperature desired for the decoking process. As discussed elsewhere herein, this temperature depends primarily on the oxidizing agent and carrier liquid used. When either oxygen or hydrogen peroxide is the oxidizing agent added and water is the carrier liquid, the decoking temperature is preferably between about 250° C. and the critical temperature of the water, more preferably between about 270° C. and about 374° C., and most preferably between about 300° C. and about 350° C. Normally, the process temperature is higher than the decoking temperature and, therefore, the reactor is cooled before the oxidant is introduced into carrier liquid. In practice, carrier liquid is commonly flowed into the reactor to adjust the temperature to the desired level. The carrier liquid is preferably heated to the desired temperature before being introduced into the downcomer of the reactor, although if sufficient heating capacity is available, it may be desirable to heat the carrier using heat source 31 at least in part. Once decoking reaction conditions have been attained, inflowing carrier liquid is substantially heated by heat exchange with the outflowing carrier stream. In some operations, when viscous feed is used, it can be desirable to switch from an input of fresh feed to an input of treated feed or lower viscosity material in order to reduce viscosity and maintain flow rate during cooling. After the desired temperature is attained, flow into the feed conduit 20 is changed from process feedstock to the carrier liquid. Once substantially all of the process feedstock has been flushed out of the system and the desired temperature of carrier liquid has been attained, oxidizing agent can be introduced into the carrier liquid.

During the decoking operation, carrier liquid is heated from an initial temperature, $T_1$, to an exchange temperature or second temperature $T_2$, by heat exchange with the outflowing carrier stream. If $T_2$ is sufficiently high, it may not be necessary to add heat in addition to that provided by the decoking operation. However, if $T_2$ is not as high a temperature as desired for the contact temperature, $T_3$, between the oxidizing agent and coke, additional heat can be added to the carrier liquid. This can be accomplished by using the indirect heat source 31 or by introducing oxidizable material into the carrier stream to provide an exothermic oxidation reaction in addition to the coke. As discussed hereinabove, oxidizable materials such as methanol or mixtures of hydrocarbons can be used. The addition of heat can also be necessary due to heat loss from the system to the environment. It is preferred to maximize the effectiveness of the heat exchange between the outflowing carrier stream and the inflowing carrier in order to minimize such heat addition. As with the processing operation, most efficient heat exchange can be obtained when turbulent flow is maintained in the heat exchange region. It is preferred that at least the outflowing stream be in substantially vertical multiphase flow. For most efficient operation, both incoming and outflowing streams should be multiphase flow. In order to induce multiphase flow, particularly in the influent stream, it may be necessary to add volatile components to the influent to provide a vapor phase in addition to the liquid phase.

When the oxidizing agent introduced to the system is a liquid, dispersable solid or is substantially soluble in the carrier liquid (e.g., hydrogen peroxide), it is preferred that the oxidizing agent be introduced into the carrier stream before the carrier enters the downcomer conduit. However, when the oxidizing agent being introduced is a gas with limited solubility under the initial pressure conditions (e.g. oxygen), it is preferred that it be injected into the carrier liquid under pressure conditions which enhance the solubility. In these circumstances, oxidant input line 34 is employed to inject an oxidant into the downflowing carrier liquid. In the preferred embodiment, oxidant input line 34 carries oxygen and the carrier liquid is water. The oxidant is injected into the liquid through one or more nozzles 36. The nozzle 36 is designed to provide for effective dispersion of the oxidant in the carrier liquid. Flow rate of oxidant is controlled by a valve 40. The nozzle 36 and input line 34 are preferably connected by a check valve 38 or other mechanism for preventing back flow of process feed (e.g., petroleum) or water into the input line 34. Prior to introducing the oxidant, the line should be flushed with an inert material such as nitrogen to avoid any possibility of a violent reaction between the oxidizing agent and oxidizable substances. In order to prevent back flow, it is also preferred to maintain a positive pressure at the nozzle 36 with respect to the carrier liquid in the adjacent portion of the reactor 10. Thus, with oxygen or mixtures of oxygen, it is preferred that a minimum flow of gas through input line 34 be maintained. One method of accomplishing this is to introduce a first mixture of oxygen with a second gas which is preferably substantially inert, e.g. nitrogen, at a flow rate greater than or equal to the minimum flow rate. When it is desired to adjust the flow rate of oxygen, the relative flow rates of the two gases can be changed to produce a second mixture, having a molar ratio of oxygen to the second gas which is different from the molar ratio of the first mixture. The flow rate of the second mixture is maintained to be equal to or greater than the minimum flow rate. Although two nozzles 36 are depicted, it is within the contemplated scope of this invention to use a single nozzle or a plurality of such nozzles if desired. Nozzles can also be located downstream of one another to inject oxidizing agent at different longitudinal locations in the stream.

In order to be economically acceptable, the rate of coke removal should be sufficiently rapid to remove substantially all of the coke within a 24 hour period. It is preferred that the coke removal time be as short as possible without overheating the carrier stream and/or the reactor surfaces. Under normal operating conditions, it is expected that at least about 3 kilograms of oxygen per kilogram of coke is used, and normally between about 5 and about 8 kilograms of oxygen per kilogram of coke is injected within the 24 hour period.

Upon initial addition of oxidizing agent, e.g. oxygen, the molar ratio of oxygen to carbon dioxide should be essentially 0:1 in the effluent stream. If the ratio is greater than about 0.1, either (1) the contact temperature, $T_3$, is too low to provide an efficient rate of decoking and additional heat should be introduced to the carrier liquid or (2) there is not sufficient mass transfer of the oxidizing agent to provide for effective contact with the coke. If the contact temperature is in excess of about 300° C. and the ratio of oxygen to carbon dioxide is above about 0.1, the amount of oxygen being introduced can be reduced. Nonetheless, as the decoking process progresses, it is normally desirable to increase the concentration of oxidizing agent in the carrier stream.

It has been found that there can be undesirable results if the flow rate of oxidant, relative to the flow rate of the carrier fluid, is too high. The oxidation rate of the coke deposits can be so high that the carrier liquid locally vaporizes or is not able to absorb the heat of the coke oxidation with sufficient rapidity. If the carrier liquid vaporizes, the vapor is unable to absorb or store heat from the reaction as readily as the liquid which can lead to the formation of hot spots and damage to the reactor vessel. The vapor is also not able to maintain reaction by-products in a fluid-dissolved state as readily as the liquid phase so that by-products can precipitate or re-deposit onto reactor walls downstream. The vapor phase does not dilute the reaction by-products as readily as the liquid phase so that corrosive by-products can be formed in a more concentrated level leading to corrosion of the vessel. Creation of vapor pockets can disturb the pressure balance of the system affecting both the downstream hydrostatic head and the pressure balance across the heat exchange wall, possibly leading to rupture of the vessel. Solid by-products of the reaction are not as readily suspended in vapor as they are in liquid so that solid by-products can settle out and reside in the bottom of the reactor rather than remaining suspended for flushing out of the reactor vessel. Therefore, it is important that the carrier remain substantially in liquid phase in the decoking region. By "substantially liquid phase" it is meant that no more than about 10 volume percent of the carrier is vaporized, and preferably no more than about 5 volume percent of the carrier is in the vapor phase.

Even when there is no substantial vaporization of the carrier liquid, an excessive reaction rate can produce heat at such a rate that it exceeds the capacity of the liquid carrier to absorb and remove the heat from the oxidation site so that local hot spots are created which can lead to thermal damage of the reactor. It is important to control the rate of oxidation to avoid any such overheating.

The rate of oxidation reaction can be monitored in several ways. A convenient, and probably the most sensitive method, is to measure pressure changes in the carrier stream. A fluctuation in pressure shows that vaporization of the carrier liquid is occurring. This indicates an excessive rate of coke oxidation with an increase in pressure in excess of about 100 psi suggesting the coke oxidation is too rapid. Another method involves measuring the amount of carbon dioxide and determining its ratio to unreacted oxidizing agent. High concentrations of carbon dioxide relative to unreacted oxidizing agent indicates the decoking is proceeding, whereas low levels indicate a slow or essentially completed coke oxidation. The bulk temperature of the carrier liquid can also be monitored to determine the level of the post-oxidation temperature, $T_4$, compared to the contact temperature, $T_3$, or the exchange temperature, $T_2$. If $T_4$ is lower than $T_3$, it may be necessary to add heat to the carrier stream as discussed hereinabove. If $T_4$ is substantially greater than $T_3$, it may be necessary to decrease the rate of addition of oxidizing agent. The difference between $T_4$ and $T_3$ should be maintained at less than about 100° C.

In addition to the generation of heat, the rate of oxidant flow and consequent rate of reaction affects the rate at which by-products are produced. If the reaction rate is too rapid with respect to the rate of flow of carrier liquid, by-products which might otherwise remain in solution can precipitate. Also, solid by-products which might otherwise remain in suspension can settle to the bottom of the reactor if the rate of by-product production is too rapid. The high volume concentration of the solid by-products leads to an increased probability of collision of by-product particulates which can produce larger agglomerate particles which cannot be maintained in suspension and settle to the bottom of the reactor vessel. Further, an increased reaction rate can lead to an increased rate of production of corrosive by-products which can cause corrosion damage of the vessel or the necessity for increased addition of pH-adjusting materials, as discussed below.

In order to prevent the problems associated with an excessive reaction rate, the flow rate of the oxidant from the nozzle 36 is controlled, relative to the flow rate of the carrier liquid through conduit 20 down the downcomer 14. By controlling this relative flow rate of oxidant, it is possible to maintain the rate of oxidation of the coke at an acceptable level.

To provide for sufficient absorption of the oxidation reaction-generated heat and for by-product suspension and dissolution, the ratio of the flow rate of the oxidizing substance to the flow rate of the carrier liquid should be maintained sufficiently low that substantially none of the carrier liquid vaporizes at the reaction pressure. The preferred operation is to provide a contact temperature, $T_3$, as high as possible to assure a rapid rate of coke oxidation. In operation, the post-oxidation temperature, $T_4$, of the carrier liquid should be maintained essentially the same as $T_3$, i.e. the difference between $T_4$ and $T_3$ should be minimized to avoid pressure fluctuations in the carrier stream. In operation, it is preferred to maximize carbon dioxide concentration while minimizing the difference between $T_4$ and $T_3$. When the carrier liquid is water and the oxidant is oxygen, the flow rate of oxygen through line 34 and the flow rate of water through conduit 20 should be adjusted to produce a temperature increase in the carrier liquid of no more than about 100° C., and preferably less than about 25° C. This temperature increase refers to the bulk temperature of the carrier liquid downstream from the oxidation site compared to the temperature of the carrier liquid upstream of the oxidation site. It is understood that the localized temperature of the carrier liquid at or adjacent to oxidation sites can exceed this increase. Within the constraints imposed by this condition on the relative flow rates, it is normally desirable to provide for high oxidant flow rates in order to minimize the length of the decoking cycle.

In order to maximize dissolution of those coke oxidation by-products which are soluble in the carrier liquid, particularly when the by-products include the metallic compounds such as vanadium compounds, it is desired to maintain the fluid in the reaction zone 16 at a neutral or slightly acidic pH. The pH of the carrier liquid can be monitored and adjusted as necessary to substantially dissolve the oxidation products and by-products products by adding appropriate agents. In addition to the pH lowering by dissolution of carbon dioxide formed by oxidation of the coke, it has been found that certain coke oxidation by-products, particularly sulfur compounds, contribute to a reduction in the pH, normally by formation of sulfuric or sulfurous acids. This acidic environment can be beneficial in that it assists in maximizing solubility of other by-products. However, the pH should not be allowed to drop to a level at which significant degradation of the reaction vessel or downstream conduits or other apparatus occurs. Thus, it is desired to maintain the pH generally above about 3 and preferably between about 5 and about 11. The lower limit depends on the materials of construction of the reactor and the apparatus in the reactor and can be readily determined by a skilled person. One method of maintaining the desired pH range is the introduction of a neutralizing or pH control agent, such as a mineral base, preferably caustic soda or lime, into the carrier liquid. It has been found that the presence of such neutralizing agents can decrease the rate at which the oxidizing agent reacts with the coke. Therefore, it can be necessary to control pH partially by reducing the amount of oxidant added instead of only increasing neutralizing agents in order to optimize the overall rate of oxidation. This optimum rate can be readily determined without undue experimentation.

The water containing the suspended solid by-products, along with fluid products such as water and carbon dioxide, is conducted upward by the riser conduit 18. Since one of the products of coke oxidation is carbon dioxide, it is convenient to monitor progress of the coke removal by measuring carbon dioxide content of the decoking effluent, such as by using the gas monitor 24. The degree to which the coke has been removed is proportional to the decrease in $CO_2$ evolution. It is preferred to conduct decoking to provide for removal of substantially all coke as indicated by substantial cessation of $CO_2$ evolution as detected by the gas monitor 24. If preferred, other oxidation products or by-products can be monitored to determine the degree of decoking. In some applications, less than substantially complete coke removal can be desirable. When it is determined that the desired amount of decoking has been accomplished, the flow of oxidant through input conduit 34 is stopped, preferably by introducing a non-oxidant fluid through conduit 34. Flow of water through input conduit 20 is switched to input of untreated feed and heat source 31 can be employed to adjust the temperature in the reaction zone 16 to that desired for production operation.

During the decoking operation, it is contemplated that the carrier fluid can be recycled. This can be economically beneficial if the effluent carrier fluid contains, for example, unreacted oxidizing agent and/or pH control agent. Optionally, the effluent in conduit 22 can be subjected to a separation means 42 to remove oxidation products and/or by-products before reintroducing the carrier fluid and oxidant through line 44 into conduit 20.

Figure 2:
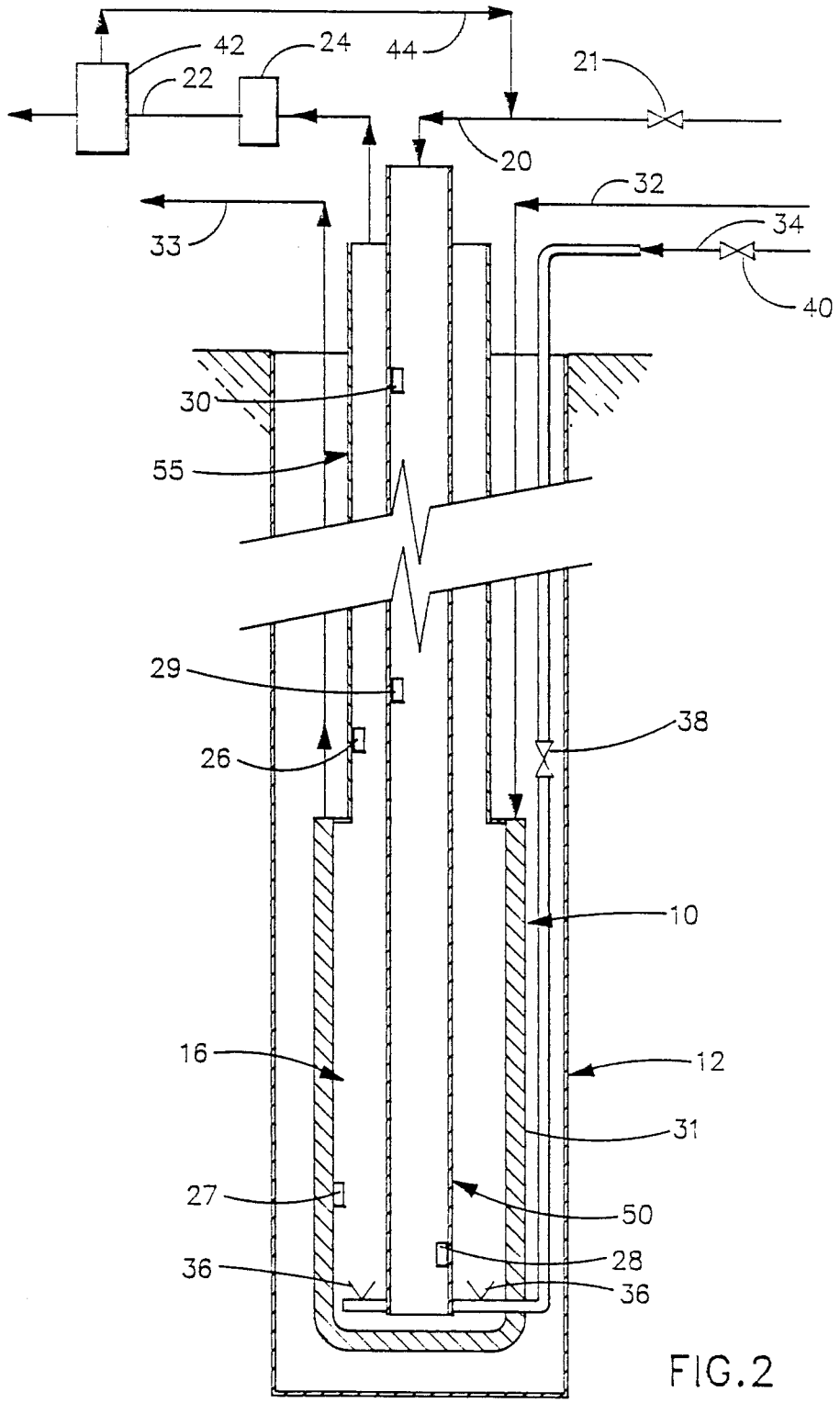
FIG. 2 is a representation of a preferred method of operation of the instant process.

FIG. 2 depicts a preferred method of operation in which during a production application flow of feed is into internal conduit 50 into reaction zone 16 with product passing upward through conduit 55. In this method of operation, nozzle 36 is located near the bottom of the reaction zone 16. The nozzle is typically oriented to provide flow of oxidant essentially parallel with the flow of carrier liquid and to aid in dispersing the oxidizing agent in the carrier liquid. Of course, multiple nozzles can be provided downstream of nozzle 36 if desired. It is contemplated that a nozzle can be provided inside conduit 50 if necessary. An advantage of the method of operation in which nozzles are located in an upward flowing stream of carrier liquid is the avoidance of the formation of gas pockets or static vapor phase regions. Such vapor regions normally rise and this is assisted rather than opposed by the upward flow of liquid. Otherwise the operation is essentially the same as described for FIG. 1 hereinabove.

The following examples are intended by way of illustration and not by way of limitation.

EXAMPLE 1

A bench-scale petroleum reactor was operated in production mode resulting in the deposit of coke on the reactor vessel walls. Coils were weighed before and after the production mode tests to determine the weight of coke deposited in the coils. Operating conditions for the production mode test runs are shown in Table 1. For runs A-D, the source of the coke was feed No. 1, a crude from Boscan, Venezuela with a viscosity of 57,960 cp and a Conradson Carbon content of 13.5%. For runs E-I, the source of the coke was feed No. 2, a crude from Cold Lake, Canada with a viscosity of 28,850 cp and a Conradson Carbon content of 12.0%.

TABLE 1

| Decoking Run No. | Production Treatment Temperature (°C.) | Production Treatment Pressure (psi) | Production Treatment Time (min.) |
|---|---|---|---|
| A | 415–435 | 1030–1070 | 4.2–5.2 |
| B | 435 | 1040–1070 | 4.3–4.9 |
| C | 415 | 2000–2040 | 2.7–4.1 |
| D | 425 | 2030–2110 | 2.9–3.8 |
| E | 435 | 1970–2090 | 0.8–1.4 |
| F | 425 | 1990–2090 | 1.7–3.2 |
| G | 445 | 2030–2100 | 3.2–4.4 |
| H | 411 | 988–1003 | 7.1–7.4 |
| I | 438 | 1007–1015 | 4.9–6.8 |

The bench-scale reactor consisted of a 50 foot coiled tubing section immersed in a fluidized bed sand heater. The coiled tubing section was pressurized by pumping water through the coil at a pressure of 1300 to 1500 psi (8.9 to 10.3 MPa). The fluid-bed reactor was heated to 300° C. In tests A, B and F, the specified concentration of $H_2O_2$ was introduced into the pressurized water stream. In test C, D, E and G, pressurized air was introduced into the water stream. The oxygen and carbon dioxide concentrations in the off-gas were monitored and the test was terminated when the off-gas contained less than 10 mole percent carbon dioxide. The coke oxidation processing conditions and results are summarized in Table 2. Runs E and G, used water to which sodium hydroxide was added to adjust the pH to 9.0. Sulfur balance was determined by measuring total sulfate production.

TABLE 2-continued

Wet Oxidation Tests for Removal of Coke

Condition: Bed temperature, 300° C.

| Run No. | Coke Source | Average Pressure psig | Source of Oxygen | Wt. of Coke in Coil (grams) | Coke Removed (Wt %) |
|---|---|---|---|---|---|
| I | Feed No. 2 | 1350 | Oxygen[7] | N.D. | 100 |

[1]Air flow to lower half of coil.
[2]Due to major restrictions in coil, this run used air only for a period of approximately 3.5 hours.
[3]Water used for this test was adjusted to pH 9.0 with NaOH.
[4]All coke remaining in coil was in the outlet leg approximately 10 inches above the bed at a temperature approximately 100° C. lower than the maximum reaction temperature and thus less reactive. Water used for this test was adjusted to pH 11 with NaOH.
[5]Oxygen flow rate ranged from 1.7 to 2.1 weight percent of total flow of water stream.
[6]Not Determined.
[7]Oxygen flow rate ranged from 1 to 6.5 weight percent of total flow of water stream.

| | Feed Flow Rates | | | Product Flow Rates | | | Liquid Product | | |
|---|---|---|---|---|---|---|---|---|---|
| Run No. | Water Wt % | Oxygen Source Wt % | Oxygen Source scfm | Stoichiometric Oxygen | Gas scfm | Liquid cc/min | Liquid pH | Solids Wt % | Sulfur Balance % |
| A | 98.6 | 1.4 | 0.012 | 2 | 0.017 | 28.6 | 2.4–3.1 | 0.008–0.04 | 79.4 |
| B | 97.2 | 2.8 | 0.021 | 2.7 | 0.023 | 29 | 2.0–3.1 | 0.001–0.02 | 57 |
| C[1] | 97.2 | 2.8 | 0.027 | 2.3 | 0.027 | 32.7 | 2.2–3.8 | 0.01–0.03 | 99 |
| D | 90 | 10 | 0.117 | 2.8 | 0.12 | 34.5 | 2.3–3.2 | 0.01–0.12 | 96.8 |
| E[2,3] | 52.7 | 47.3 | 0.115 | 1.3 | 0.115 | 12.5 | 1.7–3.9 | 0.001–0.07 | 42.2 |
| F | 97 | 3 | 0.024 | 2.8 | 0.028 | 28.9 | 2.1–5.4 | 0.02 | 100 |
| G[4] | 55.9 | 44.1 | 0.15 | 1.2 | 0.15 | 13.4 | 2.0–3.4 | 0.016–0.08 | 7.2 |
| H | | 1.7–2.1 | | | | | | | |
| I | | 1–6.5 | | | | | | | |

[1]Air flow to lower half of coil.
[2]Due to major restrictions in coil, this run used air only for a period of approximately 3.5 hours.
[3]Water used for this test was adjusted to pH 9.0 with NaOH.
[4]All coke remaining in coil was in the outlet leg approximately 10 inches above the bed at a temperature approximately 100° C. lower than the maximum reaction temperature and thus less reactive. Water used for this test was adjusted to pH 11 with NaOH.
[5]Oxygen flow rate ranged from 1.7 to 2.1 weight percent of total flow of water stream.
[6]Not Determined.
[7]Oxygen flow rate ranged from 1 to 6.5 weight percent of total flow of water stream.

TABLE 2

Wet Oxidation Tests for Removal of Coke

Condition: Bed temperature, 300° C.

| Run No. | Coke Source | Average Pressure psig | Source of Oxygen | Wt. of Coke in Coil (grams) | Coke Removed (Wt %) |
|---|---|---|---|---|---|
| A | Feed No. 1 | 1300 | 2.9 wt. % $H_2O_2$ | 23.1 | 97.8 |
| B | Feed No. 1 | 1500 | 6 wt. % $H_2O_2$ | 82 | 97.2 |
| C[1] | Feed No. 1 | 1500 | Air | 33.9 | 49 |
| D | Feed No. 1 | 1500 | Air | 10.1 | 100 |
| E[23] | Feed No. 2 | 1500 | Air | 151.3 | 100 |
| F | Feed No. 2 | 1500 | 5 wt. % $H_2O_2$ | 21.2 | 100 |
| G[4] | Feed No. 2 | 1500 | Air | 454 | 93.7 |
| H | Feed No. 2 | 1300 | Oxygen[5] | N.D.[6] | 45 |

The fluid bed reactor was heated to 300° C. For tests using dilute hydrogen peroxide, $H_2O_2$ was added to water in the proportion shown in Table 2, and the dilute hydrogen peroxide solution was pumped through the coil at 1300 to 1500 psi (8.9 to 10.3 MPa). Tests using air as the oxygen source required two feed flow streams, air and water, with the air added to the pressurized water at the bottom of the coil. The oxygen and carbon dioxide content of the off-gas was monitored throughout the test. When the off-gas contained little or no carbon dioxide, the test was terminated. The reactors were then cooled and the coil was removed and weighed to determine the amount of coke removed.

The product $CO_2$, $O_2$, $SO_4$, Ni, V, Fe, pH, and percent carbon removed for Runs A through I are shown in Tables 3–11, respectively. In these Tables "SCFH" means Standard Cubic Foot per Hour, "ppm" means parts per million, "g/l " means grams per liter, and "g/hr" means grams per hour.

TABLE 3

Gas And Product Solution Analysis

| Run Number | Time | Temp. C. | Press psi | Flow g/hr | Liquid % Solids | [Liquid Product Properties] pH | g/l $SO_4$ | ppm V | ppm Ni | ppm Fe | [Product Gas Analysis] SCFH | $O_2$ | $N_2$ | $CO_2$ | CO |
|---|---|---|---|---|---|---|---|---|---|---|---|---|---|---|---|
| A | 0955 | 302 | 1276 | | | | | | | | 0.45 | 1.08 | 0.96 | 81.18 | 16.79 |
| | 1030 | 307 | 1288 | | | | | | | | 0.30 | 4.26 | 0.71 | 86.05 | 8.98 |
| | 1100 | 305 | 1292 | 1948 | .031 | 2.65 | 0.18 | 1.5 | 1.1 | .8 | 0.30 | 4.00 | 0.59 | 88.24 | 7.18 |
| | 1130 | 297 | 1224 | | | | | | | | 0.15 | 26.22 | 1.04 | 66.91 | 5.83 |
| | 1200 | 301 | 1306 | 2028 | .008 | 2.40 | 0.98 | 15.5 | 48 | 1.2 | 0.25 | 29.19 | 1.27 | 67.73 | 1.8 |
| | 1230 | 301 | 1288 | | | | | | | | 0.40 | 78.26 | 0.61 | 18.40 | 2.73 |

TABLE 3-continued

| Run Number | Time | Temp. C. | Press psi | Liquid Flow g/hr | Gas And Product Solution Analysis [Liquid Product Properties] % Solids | pH | g/l $SO_4$ | ppm V | ppm Ni | ppm Fe | [Product Gas Analysis] SCFH | $O_2$ | $N_2$ | $CO_2$ | CO |
|---|---|---|---|---|---|---|---|---|---|---|---|---|---|---|---|
| | 1300 | 301 | 1285 | 2088 | .041 | 2.55 | 0.44 | 26.3 | 15 | .4 | 0.48 | 73.58 | 5.18 | 18.60 | 2.64 |
| | 1330 | 301 | 1277 | | | | | | | | 0.55 | 79.28 | 1.75 | 17.80 | 1.17 |
| | 1400 | 302 | 1296 | 1944 | .034 | 2.95 | 0.03 | 5.9 | 2.7 | .2 | 0.39 | 87.13 | 0.59 | 10.20 | 2.08 |
| | 1430 | | | | | | | | | | 0.54 | 85.07 | 0.41 | 13.39 | 1.12 |
| | 1500 | | | 1915 | .013 | 3.05 | 0.01 | 3 | 1 | .3 | 0.38 | 88.98 | 0.42 | 9.11 | 1.48 |

TABLE 4

| Run Number | Time | Temp. C. | Press psi | Liquid Flow g/hr | Gas And Product Solution Analysis [Liquid Product Properties] % Solids | pH | g/l $SO_4$ | ppm V | ppm Ni | ppm Fe | [Product Gas Analyses] SCFH | $O_2$ | $N_2$ | $CO_2$ | CO |
|---|---|---|---|---|---|---|---|---|---|---|---|---|---|---|---|
| B | 0900 | 301 | 1550 | | | | | | | | 0.47 | 2.18 | 0.54 | 93.74 | 3.54 |
| | 0930 | 302 | 1550 | 1884 | .02 | 2.00 | 1.58 | 68.2 | 2.1 | 1.8 | 0.66 | 3.15 | 0.26 | 93.69 | 2.89 |
| | 1000 | 301 | 1474 | | | | | | | | 0.64 | 5.69 | 1.69 | 90.15 | 2.46 |
| | 1030 | 301 | 1499 | 1842 | .01 | 2.10 | 1.51 | 80.7 | 9.2 | .5 | | | | | |
| | 1100 | 302 | 1565 | | | | | | | | 1.28 | 29.43 | 1.80 | 64.40 | 4.37 |
| | 1130 | 302 | 1548 | 1752 | .019 | 2.25 | 1.20 | 94.8 | 18 | .2 | | | | | |
| | 1200 | 304 | 1564 | | | | | | | | 1.47 | 67.55 | 0.48 | 30.17 | 1.80 |
| | 1230 | 304 | 2040 | 1648 | .009 | 2.45 | 0.53 | 29.5 | 12.2 | .1 | 0.22 | 41.57 | 0.33 | 57.67 | 0.44 |
| | 1300 | 302 | 2040 | | | | | | | | 0.68 | 90.70 | 1.14 | 7.44 | 0.72 |
| | 1330 | 302 | 2059 | 1600 | .007 | 3.00 | 0.03 | 6.1 | 2.1 | .2 | 0.71 | 95.84 | 0.28 | 2.91 | 0.97 |
| | 1400 | 302 | 2020 | | | | | | | | 0.72 | 96.01 | 0.28 | 2.85 | 0.85 |
| | 1430 | | | 1520 | .001 | 3.10 | 0.01 | 2.5 | .6 | .1 | | | | | |

TABLE 5

| Run Number | Time | Temp. C. | Press psi | Liquid Flow g/hr | Gas And Product Solution Analysis [Liquid Product Properties] % Solids | pH | g/l $SO_4$ | ppm V | ppm Ni | ppm Fe | [Product Gas Analyses] SCFH | $O_2$ | $N_2$ | $CO_2$ | CO |
|---|---|---|---|---|---|---|---|---|---|---|---|---|---|---|---|
| C | 0915 | | | | | | | | | | 0.02 | 12.77 | 82.60 | 4.11 | 0.53 |
| | 0945 | | | | | | | | | | 0.04 | 8.33 | 87.16 | 4.21 | 0.28 |
| | 1000 | 305 | 1459 | 1763 | .013 | 3.75 | 0.12 | 0 | .2 | .1 | | | | | |
| | 1020 | | | | | | | | | | 0.42 | 0.26 | 82.10 | 17.54 | 0.09 |
| | 1100 | 303 | 1495 | 2287 | .014 | 2.65 | 0.10 | .7 | .2 | 1.2 | | | | | |
| | 1115 | | | | | | | | | | 1.10 | 0.14 | 89.34 | 10.47 | 0.05 |
| | 1125 | 301 | 1468 | | | | | | | | 0.20 | 0.22 | 88.12 | 11.59 | 0.07 |
| | 1200 | 302 | 1488 | 1990 | .011 | 2.50 | 0.21 | 3.4 | .4 | .7 | | | | | |
| | 1230 | 301 | 1511 | | | | | | | | 4.60 | 14.35 | 74.37 | 11.28 | 0.00 |
| | 1300 | 304 | 1470 | 1906 | .012 | 2.20 | 0.73 | 12.9 | 17 | 2.1 | | | | | |
| | 1320 | | | | | | | | | | 2.81 | 12.98 | 79.60 | 7.43 | 0.00 |
| | 1345 | | | | | | | | | | 0.52 | 11.90 | 78.04 | 10.06 | 0.00 |
| | 1400 | 303 | 1470 | 1872 | .006 | 2.55 | 0.26 | 10.3 | 1.2 | .1 | | | | | |
| | 1415 | | | | | | | | | | 0.49 | 22.05 | 74.54 | 3.42 | 0.00 |
| | 1430 | 298 | 1496 | 2702 | .026 | 2.60 | 0.27 | 8.8 | 1 | .3 | 0.48 | 20.80 | 76.65 | 2.55 | 0.00 |

TABLE 6

| Run Number | Time | Temp. C. | Press psi | Liquid Flow g/hr | Gas And Product Solution Analysis [Liquid Product Properties] % Solids | pH | g/l $SO_4$ | ppm V | ppm Ni | ppm Fe | [Product Gas Analyses] SCFH | $O_2$ | $N_2$ | $CO_2$ | CO |
|---|---|---|---|---|---|---|---|---|---|---|---|---|---|---|---|
| D | 0730 | 301 | 1534 | | | | | | | | 0.59 | 1.85 | 64.94 | 32.35 | 0.86 |
| | 0740 | | | 2303 | .004 | 2.50 | 0.20 | .5 | 6.2 | 4.8 | | | | | |
| | 0800 | 301 | 1539 | | | | | | | | 1.32 | 0.62 | 79.34 | 18.34 | 1.70 |
| | 0830 | 303 | 1530 | | | | | | | | 0.11 | 0.67 | 80.55 | 17.48 | 1.30 |
| | 0840 | | | 2022 | .013 | 2.58 | 0.15 | 1.1 | 2.6 | 2.2 | | | | | |
| | 0900 | 302 | 1554 | | | | | | | | 14.14 | 0.23 | 72.78 | 25.59 | 1.40 |
| | 0930 | 302 | 1557 | | | | | | | | 2.67 | 13.39 | 80.58 | 5.75 | 0.29 |
| | 0940 | | | 2197 | .023 | 2.29 | 0.44 | 10.1 | 138 | 1.6 | | | | | |
| | 1000 | 301 | 1568 | | | | | | | | 3.91 | 18.67 | 80.88 | 0.34 | 0.12 |
| | 1030 | 300 | 1563 | | | | | | | | 0.12 | 18.70 | 78.83 | 2.45 | 0.02 |
| | 1045 | | | 1806 | .025 | 2.58 | 0.22 | 14.9 | 4.2 | .2 | | | | | |
| | 1145 | | | 2029 | .01 | 3.16 | 0.01 | 3.8 | .9 | 0 | | | | | |

TABLE 7

| Run Number | Time | Temp. C. | Press psi | Liquid Flow g/hr | Gas And Product Solution Analysis [Liquid Product Properties] % Solids | pH | g/l $SO_4$ | ppm V | ppm Ni | ppm Fe | [Product Gas Analyses] SCFH | $O_2$ | $N_2$ | $CO_2$ | CO |
|---|---|---|---|---|---|---|---|---|---|---|---|---|---|---|---|
| E | 0340 | | | | | | | | | | 0.03 | 21.62 | 78.14 | 0.11 | 0.14 |
| | 0400 | | | | | | | | | | 0.03 | 20.51 | 77.45 | 0.25 | 1.79 |
| | 0415 | | | | | | | | | | 0.01 | 19.20 | 79.41 | 0.41 | 0.98 |
| | 0430 | | | | | | | | | | 0.06 | 18.68 | 79.90 | 0.72 | 0.70 |
| | 0445 | | | | | | | | | | 0.20 | 9.89 | 81.31 | 8.30 | 0.50 |
| | 0500 | 299 | 1580 | 1504 | .02 | 3.90 | 0.01 | .4 | .2 | .3 | | | | | |
| | 0515 | | | | | | | | | | 0.30 | 3.38 | 88.99 | 6.34 | 1.29 |
| | 0530 | 304 | 1507 | | | | | | | | 0.05 | 0.30 | 81.10 | 18.60 | 0.00 |
| | 0545 | | | | | | | | | | 0.06 | 2.14 | 79.86 | 17.32 | 0.68 |
| | 0600 | 291 | 1113 | 1100 | .066 | 2.78 | 0.04 | .4 | .2 | 1.7 | | | | | |
| | 0615 | | | | | | | | | | 1.64 | 0.56 | 85.15 | 12.94 | 1.35 |
| | 0635 | 303 | 1640 | | | | | | | | 1.47 | 1.67 | 81.94 | 16.25 | 0.13 |
| | 0700 | | | 1112 | .04 | 2.0 | 0.79 | 2.6 | 18 | 4.8 | 1.65 | 0.20 | 76.52 | 22.96 | 0.32 |
| | 1130 | 306 | 1466 | | | | | | | | 4.45 | 21.44 | 78.02 | 0.55 | 0.00 |
| | 1230 | 300 | 1470 | 1617 | .029 | 1.72 | 6.76 | 15.7 | 500 | 430 | 0.12 | 19.55 | 77.85 | 2.49 | 0.11 |

TABLE 8

| Run Number | Time | Temp. C. | Press psi | Liquid Flow g/hr | Gas And Product Solution Analysis [Liquid Product Properties] % Solids | pH | g/l $SO_4$ | ppm V | ppm Ni | ppm Fe | [Product Gas Analyses] SCFH | $O_2$ | $N_2$ | $CO_2$ | CO |
|---|---|---|---|---|---|---|---|---|---|---|---|---|---|---|---|
| F | 0705 | 300 | 1544 | | | | | | | | 0.43 | 12.14 | 50.46 | 36.20 | 1.20 |
| | 0735 | 300 | 1535 | 1145 | .022 | 5.40 | 0.03 | .2 | .5 | .1 | 0.55 | 14.97 | 3.74 | 78.64 | 2.65 |
| | 0810 | 301 | 1532 | | | | | | | | 0.62 | 44.83 | 4.27 | 45.14 | 5.76 |
| | 0835 | 300 | 1528 | 2754 | 0.22 | 2.10 | 0.93 | 5.9 | 29 | 7.1 | 0.85 | 75.34 | 0.83 | 21.38 | 2.45 |
| | 0905 | 301 | 1556 | | | | | | | | 0.67 | 78.55 | 15.38 | 6.74 | 0.32 |
| | 0935 | 300 | 1554 | 2162 | .021 | 2.43 | .13 | 3.1 | 4.1 | .6 | 1.26 | 91.15 | 4.12 | 4.89 | 0.04 |

TABLE 9

| Run Number | Time | Temp. C. | Press psi | Liquid Flow g/hr | Gas And Product Solution Analysis [Liquid Product Properties] % Solids | pH | g/l $SO_4$ | ppm V | ppm Ni | ppm Fe | [Product Gas Analyses] SCFH | $O_2$ | $N_2$ | $CO_2$ | CO |
|---|---|---|---|---|---|---|---|---|---|---|---|---|---|---|---|
| G | 2000 | 288 | 1491 | 970 | .014 | 6.05 | 0.02 | .8 | .2 | .2 | | | | | |
| | 2205 | 302 | 1439 | | | | | | | | 0.85 | 0.41 | 82.29 | 16.89 | 0.41 |
| | 2215 | | | 2870 | .053 | 3.42 | 0.03 | .7 | .2 | 2.9 | | | | | |
| | 2235 | 296 | 1503 | | | | | | | | 0.85 | 0.43 | 83.28 | 15.73 | 0.56 |
| | 2305 | 294 | 1467 | | | | | | | | 0.95 | 4.37 | 83.79 | 11.04 | 0.80 |
| | 2315 | | | 1322 | .039 | 2.28 | 0.02 | .5 | .2 | 2.7 | | | | | |
| | 2335 | 288 | 1492 | | | | | | | | 1.90 | 4.56 | 80.43 | 14.89 | 0.12 |
| | 0015 | | | 885 | .079 | 2.05 | 0.63 | 1.6 | 6.5 | 30 | | | | | |
| | 0035 | 302 | 1511 | | | | | | | | 3.20 | 1.82 | 81.70 | 16.43 | 0.05 |
| | 0540 | | | | | | | | | | 2.66 | 1.50 | 79.42 | 17.15 | 1.93 |
| | 0600 | | | | | | | | | | 3.23 | 18.83 | 78.31 | 2.81 | 0.05 |
| | 0625 | | | 527 | .062 | 1.98 | 1.14 | .9 | 2.3 | 78 | | | | | |
| | 1900 | 300 | 1496 | | | | | | | | 0.29 | 11.83 | 72.05 | 15.82 | 0.30 |
| | 1930 | 298 | 1586 | | | | | | | | 1.09 | 8.06 | 78.47 | 13.10 | 0.37 |
| | 2000 | 299 | 1697 | 1949 | .016 | 2.02 | 1.21 | 6.4 | 38 | 79 | 7.59 | 17.36 | 80.99 | 1.33 | 0.32 |
| | 2051 | | | | | | | | | | 6.37 | 8.19 | 81.28 | 9.56 | 0.97 |
| | 2225 | | | 812 | .027 | 2.02 | 1.06 | 54.6 | 29 | 21 | | | | | |

TABLE 10

| Run Number | Time | Temp. C. | Press psi | Oxygen Source | Liquid Flow g/hr | Gas And Product Solution Analysis Liquid Product Properties % Solids | pH | g/l $SO_4$ | ppm V | ppm Ni | ppm Fe | Product Gas Analyses SCFH | $O_2$ | $N_2$ | $CO_2$ | CO |
|---|---|---|---|---|---|---|---|---|---|---|---|---|---|---|---|---|
| H | 0920 | | | .Oxygen | | | | | | | | 0.15 | 3.18 | 96.47 | 0.35 | 0.00 |
| | 0930 | 301 | 1086 | | 2009 | | 6.5 | 0.03 | 5 | 1 | 2 | | | | | |
| | 1010 | | | | | | | | | | | 0.39 | 0.93 | 34.27 | 64.05 | 0.75 |
| | 1030 | 298 | 1290 | | 1941 | | 2.4 | 0.69 | 5 | 35 | 29 | 0.19 | 1.27 | 16.54 | 81.02 | 1.17 |
| | 1055 | 298 | 1299 | | | | | | | | | 0.23 | 3.11 | 39.52 | 56.22 | 1.15 |
| | 1115 | | | | | | | | | | | 0.23 | 4.11 | 53.95 | 40.70 | 1.24 |
| | 1130 | 297 | 1293 | | 2259 | | 2.6 | 0.42 | 6 | 25 | 2 | 0.17 | 72.10 | 14.26 | 9.01 | 4.63 |
| | 1155 | 297 | 1298 | | | | | | | | | 0.68 | 89.41 | 1.65 | 7.75 | 1.19 |
| | 1230 | 297 | 1301 | | 2633 | | 3.0 | 0.09 | 5 | 2 | 1 | | | | | |
| | 1330 | 298 | 1490 | | 2109 | | 3.2 | 0.06 | 5 | 1 | 1 | | | | | |

TABLE 11

| Run Number | Time | Temp. C. | Press psi | Oxygen Source | Liquid Flow g/hr | Gas And Product Solution Analysis: Liquid Product Properties: % Solids | pH | g/l $SO_4$ | ppm V | ppm Ni | ppm Fe | Product Gas Analyses: SCFH | $O_2$ | $N_2$ | $CO_2$ | CO |
|---|---|---|---|---|---|---|---|---|---|---|---|---|---|---|---|---|
| 1 | 0825 | 300 | 1194 | Oxygen | 1826 | | 5.7 | 0.06 | 5 | 1 | 1 | | | | | |
| | 0850 | | | | | | | | | | | 0.40 | 12.64 | 87.09 | 0.27 | 0.00 |
| | 0925 | 304 | 1286 | | 1842 | | 5.3 | 0.06 | 5 | 1 | 1 | 0.29 | 10.22 | 89.51 | 0.27 | 0.00 |
| | 0950 | | | | | | | | | | | 0.25 | 9.19 | 90.58 | 0.23 | 0.00 |
| | 1025 | 304 | 1302 | | 1706 | | 2.9 | 0.21 | 5 | 2 | 8 | 0.64 | 5.94 | 85.70 | 8.35 | 0.00 |
| | 1050 | | | | | | | | | | | 0.47 | 2.57 | 50.36 | 43.16 | 3.91 |
| | 1125 | 303 | 1309 | | 1601 | | 2.5 | 0.72 | 5 | 10 | 31 | 0.76 | 1.51 | 13.94 | 75.13 | 9.42 |
| | 1150 | | | | | | | | | | | 0.54 | 0.61 | 5.04 | 85.29 | 9.06 |
| | 1225 | 302 | 1313 | | 1439 | | 2.4 | 1.05 | 5 | 16 | 21 | 0.75 | 3.16 | 10.89 | 78.63 | 7.32 |
| | 1250 | | | | | | | | | | | 0.53 | 2.52 | 5.01 | 85.72 | 6.76 |
| | 1325 | 301 | 1292 | | 1411 | | 2.4 | 1.05 | 6 | 16 | 17 | 0.79 | 2.68 | 4.89 | 85.42 | 7.01 |
| | 1355 | | | | | | | | | | | 0.89 | 2.33 | 1.53 | 89.61 | 6.53 |
| | 1425 | 302 | 1313 | | 1383 | | 2.3 | 1.35 | 7 | 24 | 9 | 1.26 | 4.81 | 6.98 | 84.41 | 3.80 |
| | 0830 | 302 | 1153 | | 1583 | | 2.5 | 0.75 | 5 | 24 | 67 | | | | | |
| | 0930 | 303 | 1276 | | 1792 | | 2.3 | 1.62 | 5 | 62 | 18 | | | | | |
| Day 2 | 0937 | | | | | | | | | | | 0.93 | 0.54 | 0.99 | 94.44 | 4.04 |
| | 1007 | 304 | 1355 | | | | | | | | | 0.81 | 2.01 | 0.86 | 90.63 | 6.49 |
| | 1030 | 303 | 1344 | | 1317 | | 2.3 | 1.11 | 11 | 13 | 3 | | | | | |
| | 1040 | | | | | | | | | | | 1.01 | 2.74 | 1.36 | 90.64 | 5.25 |
| | 1103 | 302 | 1361 | | | | | | | | | 0.85 | 13.06 | 14.46 | 70.46 | 2.02 |
| | 1115 | | | | | | | | | | | 0.44 | 41.20 | 9.87 | 32.96 | 15.97 |
| | 1130 | 302 | 1299 | | 1169 | | 2.5 | 0.60 | 6 | 11 | 1 | | | | | |
| | 1145 | | | | | | | | | | | 1.16 | 70.96 | 2.16 | 24.20 | 2.68 |
| | 1200 | 302 | 1298 | | | | | | | | | .59 | 77.15 | 1.05 | 20.45 | 1.36 |
| | 1230 | | | | 1153 | | 2.8 | 1.05 | 5 | 7 | 3 | | | | | |

As the data show, coke can be removed efficiently by oxidation when the effective oxidizing agent (oxygen) is added from either gaseous or liquid sources. The off-gas was found to contain minor amounts of carbon monoxide and methane in addition to greater amounts of carbon dioxide, oxygen, and nitrogen. Hydrogen sulfide and sulfur dioxide were not detected in the off-gas. The liquids produced during each test were analyzed for solids, pH, sulfate, vanadium, nickel, and iron with the results as shown. Substantially all oxidation by-products were dissolved or suspended in the water. There was no substantial thermal or corrosion damage to the apparatus.

EXAMPLE 2

A pilot-scale subterranean vertical tube reactor was used to process a petroleum feed. The petroleum which was processed was a heavy crude from Cold Lake, Canada with a viscosity of 31,360 cp at 25° C. and a Conradson Carbon content of 13.5% and an asphaltene content of 13.5%. Sulfur content was 4.3% and water content was 7.3%. This feed was processed for 48 hours at a temperature of about 418° C. and a pressure of 1750 to 2000 psi (12.0 to 13.8 MPa) with a flow rate of 1 gallon per minute (gpm) (0.0063 l/sec.). The reactor section was 93 feet 10 inches (28.6 m) in length and was disposed underground with the bottom of the reactor being 343 feet (104.5 m) below the surface. Oil processing was terminated after 48 hours, at which time a layer of coke was deposited on the reactor walls as indicated by an increase in the difference between the reactor wall and the oil temperature, caused by a decrease in heat transfer efficiency across the reactor wall.

After oil processing was terminated, flow was switched from fresh feed to processed oil and the reactor was cooled to 570° F. (299° C.). Upon reaching this temperature, water flow was begun. The discharge from the reactor was monitored visually for oil content. Air flow into the reactor was started when no oil was seen in the effluent. During coke oxidation phase, liquid and gaseous samples were withdrawn every one to two hours. The liquid was analyzed for pH, sulfur, bicarbonate, vanadium, nickel and iron. Caustic in the form of sodium hydroxide was added to the feed water to keep the effluent above a pH of 5. The gases from the reactor were analyzed for oxygen, carbon dioxide, and carbon monoxide to monitor the extent of coke oxidation in the reactor. The oxygen source was then switched to hydrogen peroxide. The air flow was stopped and a 2.5 weight percent hydrogen peroxide solution in the carrier liquid was fed to the reactor. Hydrogen peroxide concentration was increased to 10 weight percent for the last few hours of oxidation to remove any remaining coke. Run conditions are given in Table 12.

TABLE 12

Pilot Scale Reaction Conditions

| Sample Number | Run Time | Water Flow gpm | Gas Flow cfm | Coax Feed Temperature, °F.: In | 34 m | 49 m | 61 m | 77 m | Coax Product Temperature, °F.: 77 m | 61 m | 34 m | Out |
|---|---|---|---|---|---|---|---|---|---|---|---|---|
| 1 | 00:00 | 0.90 | 5.30 | 91 | 168 | 198 | 237- | 276 | 256 | 218 | 105 | 104 |
| 2 | 2:00 | 0.88 | 5.35 | 81 | 166 | 198 | 231 | 265 | 244 | 209 | 98 | 100 |
| 3 | 4:00 | 0.86 | 5.95 | 71 | 138 | 168 | 201 | 240 | 218 | 182 | 85 | 89 |
| 4 | 6:00 | 0.85 | 5.90 | 69 | 135 | 166 | 202 | 245 | 224 | 185 | 84 | 84 |
| 5 | 8:00 | 0.91 | 5.60 | 69 | 138 | 169 | 208 | 252 | 233 | 192 | 87 | 87 |
| 6 | 10:00 | 0.86 | 5.70 | 70 | 149 | 182 | 223 | 273 | 245 | 203 | 91 | 89 |
| 7 | 12:30 | 1.00 | 6.30 | 69 | 149 | 186 | 236 | 269 | 241 | 199 | 87 | 86 |
| 8 | 13:30 | 0.88 | 6.20 | 69 | 150 | 187 | 228 | 273 | 244 | 201 | 87 | 86 |
| 9 | 14:30 | 1 | 6.00 | 69 | 165 | 206 | 256 | 316 | 287 | 235 | 98 | 98 |

TABLE 12-continued

Pilot Scale Reaction Conditions

| | | | | | | | | | | | |
|---|---|---|---|---|---|---|---|---|---|---|---|
| 10 | 15:30 | 2.38 | 72 | 138 | 226 | 380 | 401 | 406 | 250 | 79 | 78 |
| 11 | 16:30 | 1.57 | 71 | 78 | 83 | 91 | 106 | 102 | 90 | 75 | 74 |
| 12 | 17:30 | 1.76 | 71 | 153 | 199 | 236 | 281 | 247 | 207 | 74 | 72 |
| 13 | 18:30 | 1.90 | 70 | 120 | 150 | 189 | 238 | 207 | 166 | 81 | 80 |
| 14 | 19:30 | 2.22 | 69 | 134 | 164 | 195 | 234 | 203 | 170 | 75 | 74 |
| 15 | 20:30 | 2.83 | 70 | 127 | 157 | 189 | 231 | 197 | 162 | 73 | 72 |
| 16 | 21:30 | 2.09 | 70 | 128 | 155 | 188 | 231 | 208 | 173 | 85 | 85 |
| 17 | 22:30 | 1.99 | 69 | 118 | 142 | 171 | 212 | 177 | 148 | 74 | 74 |
| 18 | 24:00 | 1.70 | 69 | 122 | 146 | 172 | 207 | 179 | 150 | 75 | 74 |
| 19 | 25:00 | | 70 | 153 | 192 | 253 | 478 | 267 | 198 | 77 | 74 |
| 20 | 25:30 | 4.20 | 69 | 467 | 415 | 385 | 365 | 381 | 409 | 78 | 75 |
| 21 | 26:30 | 5.50 | 70 | 356 | 316 | 297 | 294 | 296 | 304 | 200 | 207 |
| 22 | 27:30 | 3.60 | 81 | 79 | 79 | 81 | 90 | 97 | 86 | 77 | 79 |
| 23 | 28:30 | 1.95 | 80 | 98 | 123 | 140 | 142 | 130 | 114 | 81 | 81 |

| Sample | String Temperature, °F. | | | | | | | | | | Insulation | |
|---|---|---|---|---|---|---|---|---|---|---|---|---|
| | Annular (Feed) | | | Interior (Product) | | Reactor Feed Temperature, °F. | | | | | Temperature, °F. | |
| Number | 15 m | 46 m | 77 m | 15 m | 46 m | 0 m | 16 m | 21 m | 23 m | 30 m | Top | Bottom |
| 1 | 335 | 440 | 533 | 353 | 440 | 521 | 566 | 573 | 578 | 582 | 109 | 122 |
| 2 | 317 | 408 | 479 | 331 | 405 | 470 | 504 | 535 | 552 | 561 | 111 | 123 |
| 3 | 309 | 431 | 517 | 317 | 424 | 497 | 540 | 558 | 566 | 570 | 111 | 122 |
| 4 | 317 | 443 | 524 | 340 | 444 | 503 | 548 | 566 | 574 | 577 | 111 | 122 |
| 5 | 336 | 459 | 529 | 350 | 457 | 504 | 553 | 568 | 575 | 578 | 111 | 123 |
| 6 | 345 | 463 | 528 | 358 | 458 | 499 | 550 | 565 | 571 | 575 | 111 | 123 |
| 7 | 339 | 458 | 532 | 351 | 451 | 507 | 507 | 575 | 583 | 586 | 111 | 123 |
| 8 | 346 | 471 | 543 | 364 | 467 | 515 | 566 | 580 | 586 | 590 | 112 | 123 |
| 9 | 483 | 519 | 552 | 384 | 521 | 524 | 568 | 582 | 588 | 593 | 112 | 124 |
| 10 | 397 | 463 | 549 | 398 | 554 | 554 | 578 | 594 | 601 | 603 | 113 | 124 |
| 11 | 171 | 392 | 456 | 171 | 357 | 452 | 506 | 567 | 585 | 589 | 113 | 124 |
| 12 | 371 | 435 | 488 | 381 | 433 | 494 | 526 | 561 | 588 | 587 | 111 | 124 |
| 13 | 347 | 428 | 518 | 352 | 424 | 518 | 548 | 574 | 593 | 593 | 110 | 123 |
| 14 | 326 | 452 | 529 | 324 | 441 | 534 | 558 | 559 | 578 | 581 | 110 | 123 |
| 15 | 332 | 448 | 545 | 325 | 437 | 552 | 572 | 565 | 569 | 571 | 111 | 123 |
| 16 | 349 | 452 | 567 | 349 | 446 | 570 | 589 | 584 | 576 | 573 | 111 | 122 |
| 17 | 310 | 461 | 573 | 324 | 451 | 578 | 596 | 592 | 581 | 577 | 112 | 122 |
| 18 | 308 | 477 | 584 | 296 | 459 | 588 | 597 | 596 | 585 | 581 | 113 | 122 |
| 19 | 465 | 484 | 579 | 459 | 465 | 581 | 592 | 594 | 591 | 593 | 114 | 123 |
| 20 | 385 | 435 | 535 | 387 | 426 | 541 | 565 | 574 | 576 | 580 | 114 | 124 |
| 21 | 343 | 425 | 565 | 342 | 412 | 568 | 585 | 584 | 580 | 577 | 112 | 123 |
| 22 | 211 | 266 | 356 | 189 | 275 | 535 | 589 | 590 | 578 | 569 | 113 | 122 |
| 23 | 297 | 295 | 488 | 187 | 282 | 487 | 531 | 556 | 567 | 572 | 112 | 121 |

| Sample | Pressure, psig | | | | | |
|---|---|---|---|---|---|---|
| Number | Feed In | Feed Out | Reactor In | Reactor Out | Product In | Product Out |
| 1 | 1499 | 1513 | 1509 | 1480 | 1465 | 1415 |
| 2 | 1490 | 1519 | 1518 | 1428 | 1451 | 1394 |
| 3 | 1487 | 1495 | 1497 | 1460 | 1467 | 1431 |
| 4 | 1538 | 1540 | 1411 | 1422 | 1507 | 1447 |
| 5 | 1548 | 1548 | 1547 | 1505 | 1523 | 1464 |
| 6 | 1536 | 1539 | 1536 | 1502 | 1516 | 1458 |
| 7 | 1673 | 1693 | 1677 | 1635 | 1644 | 1594 |
| 8 | 1658 | 1683 | 1669 | 1654 | 1652 | 1603 |
| 9 | 1670 | 1698 | 1690 | 1658 | 1662 | 1610 |
| 10 | 1667 | 1674 | 1641 | 1621 | 1598 | 1568 |
| 11 | 1784 | 1747 | 1751 | 1705 | 1685 | 1648 |
| 12 | 1678 | 1722 | 1698 | 1678 | 1647 | 1621 |
| 13 | | 1799 | 1780 | 1697 | 1722 | 1638 |
| 14 | 1743 | 1709 | 1700 | 1653 | 1648 | 1604 |
| 15 | 1605 | 1670 | 1645 | 1629 | 1600 | 1573 |
| 16 | 1769 | 1746 | 1726 | 1699 | 1674 | 1644 |
| 17 | 1674 | 1729 | 1708 | 1692 | 1665 | 1641 |
| 18 | 1702 | 1666 | 1662 | 1669 | 1645 | 1618 |
| 19 | 1650 | 1704 | 1632 | 1668 | 1646 | 1618 |
| 20 | 1728 | 1736 | 1681 | 1682 | 1664 | 1634 |
| 21 | 1815 | 1834 | 1748 | 1730 | 1741 | 1689 |
| 22 | 1726 | 1777 | 1786 | 1739 | 1724 | 1699 |
| 23 | 1871 | 1700 | 1789 | 1736 | 1729 | 1702 |

1 Water flow gauge not working.

Following decoking, water was fed to the reactor to flush any hydrogen peroxide from the reactor system. Oil flow was then begun to the reactor.

The results of analyses of the gas and liquid samples are shown in Table 13.

TABLE 13

| Sample Number | Temp °C. | Pressure psig | Oxidant | pH | Analysis of Oxidation Samples: Liquid Analysis: Bicarbonate g/l | Sulfate g/l | Vanadium ppm | Nickel ppm | Iron ppm | Gas Analysis, %: $O_2$ | $CO_2$ | CO |
|---|---|---|---|---|---|---|---|---|---|---|---|---|
| 1 | 305 | 1480 | Air/Water | 2.6 | 0 | 0.60 | 3.2 | 10.9 | 5.2 | 19.5 | 0.4 | 0.1 |
| 2 | 294 | 1428 | Air/Water | 6.5 | 0.121 | 0.01 | 14.0 | 3.0 | 3.6 | 17.4 | 0.9 | 0.1 |
| 3 | 299 | 1460 | Air/Water | 8.2 | 0.224 | 0.01 | 13.5 | 0.4 | 0.2 | 19.2 | 0.4 | 0.1 |
| 4 | 303 | 1422 | Air/Water | 8.1 | 0.248 | 0.01 | 11.2 | 0.4 | 0.5 | 16.9 | 1.3 | 0.1 |
| 5 | 303 | 1505 | Air/Water | 8.4 | 0.266 | 0.01 | 9.2 | 0.2 | 0.3 | 17.9 | 0.6 | 0.1 |
| 6 | 302 | 1502 | Air/Water | 8.0 | 0.0908 | 0.01 | 6.9 | 0.1 | 0.1 | 18.4 | 0.6 | 0.1 |
| 7 | 308 | 1635 | Air/Water | 3.0 | 0 | 0.05 | 6.4 | 1.3 | 0.2 | 16.9 | 1.9 | 0.1 |
| 8 | 310 | 1654 | Air/Water | 3.0 | 0 | 0.05 | 9.2 | 1.1 | 0.1 | 17.0 | 1.8 | 0.1 |
| 9 | 312 | 1658 | Air/Water | 3.0 | 0 | 0.08 | 8.8 | 1.0 | 0.4 | 17.4 | 1.6 | 0.1 |
| 10 | 317 | 1621 | 5% $H_2O_2$ | 2.8 | 0 | 0.40 | 26.5 | 3.3 | 0.1 | 20 | 17 | 1.4 |
| 11 | 309 | 1705 | 2.5% $H_2O_2$ | 2.9 | 0 | 0.16 | 16.6 | 2.0 | 0.7 | 20 | 2.5 | 0.1 |
| 12 | 308 | 1678 | 2.5% $H_2O_2$ | 2.7 | 0 | 0.53 | 34.5 | 10.4 | 2.6 | 20 | 23 | 0.7 |
| 13 | 312 | 1699 | 2.5% $H_2O_2$ | 2.7 | 0 | 0.60 | 40.2 | 11.6 | 4.5 | 20 | 10 | 0.5 |
| 14 | 305 | 1653 | 2.5% $H_2O_2$ | 2.8 | 0 | 0.53 | 30.0 | 9.1 | 3.0 | 20 | 3.2 | 0.1 |
| 15 | 299 | 1629 | 2.5% $H_2O_2$ | 2.8 | 0 | 0.40 | 21.1 | 8.1 | 3.0 | 20 | 5.9 | 0.3 |
| 16 | 300 | 1699 | 2.5% $H_2O_2$ | 2.9 | 0 | 0.28 | 14.7 | 6.5 | 2.5 | 20 | 2.9 | 0.1 |
| 17 | 303 | 1692 | 2.5% $H_2O_2$ | 3.0 | 0 | 0.20 | 8.9 | 4.0 | 1.7 | 20 | 1.0 | 0.0 |
| 18 | 305 | 1669 | 2.5% $H_2O_2$ | 3.1 | 0 | 0.01 | 2.5 | 1.1 | 0.7 | 20 | 0.0 | 0.0 |
| 19 | 312 | 1668 | 10% $H_2O_2$ | 3.2 | 0 | 0.01 | 1.2 | 0.7 | 0.5 | 20 | 1.0 | 0.0 |
| 20 | 304 | 1682 | 10% $H_2O_2$ | 3.2 | 0 | 0.01 | 0.9 | 0.4 | 0.3 | 20 | 1.0 | 0.0 |
| 21 | 303 | 1730 | 10% $H_2O_2$ | 2.8 | 0 | 0.01 | 3.2 | 0.6 | 0.4 | 20 | 1.8 | 0.0 |
| 22 | 298 | 1739 | None | 2.8 | 0 | 0.01 | 0.9 | 0.9 | 0.6 | 20 | 0.0 | 0.0 |
| 23 | 300 | 1736 | None | 2.8 | 0 | 0.05 | 0.7 | 0.9 | 0.6 | 20 | 0.0 | 0.0 |

The amount of coke removed was determined by analyzing the carbon content in the reactor off-gas (primarily $CO_2$) and liquid effluent (primarily bicarbonate, when pH was greater than 4.3). It was previously determined that coke from this feed contained 85.9% carbon. On this basis, it was determined that 8.48 pounds (3.85 kg) of coke were present on the reactor walls before decoking. Following disassembly of the reactor, a small amount (177.17 g) of dry coke was recovered from the bottom of the reactor. This coke contained 21.26 g sand and 155.91 g of organic coke. From these numbers it was determined that 95.9 percent of the coke was removed during oxidation. It was found that high caustic concentration in the water inhibited oxidation. Apparently, the improved contact of hydrogen peroxide oxidant with coke, as compared to the contact of oxygen with the coke, resulted in an increase in oxidation rate when hydrogen peroxide was employed. Vanadium, nickel, iron, and sulfur concentrations in the liquid paralleled the coke removal rates during oxidation. Substantially no solids accumulated in the bottom of the reactor during the oxidation process. There was substantially no thermal or corrosion damage to the reactor as a result of normal operations.

Although the foregoing invention has been described in some detail by way of illustration and example for purposes of clarity and understanding, it will be obvious that certain changes and modifications may be practiced within the scope of the invention, as limited only by the scope of the appended claims.

What is claimed is:

1. A method useful for removing coke deposited on surfaces in a vertical tube reactor said method comprising:

(a) passing an influent stream of carrier liquid at a first temperature into a reactor containing coke deposits;

(b) increasing the temperature of said carrier liquid from a first temperature to a second temperature to provide heated carrier liquid;

(c) contacting said coke with an oxidizing agent in the presence of said heated carrier liquid at a contact temperature to effect the exothermic oxidation of said coke said contacting occurring under a superatmospheric pressure greater than the vapor pressure of said carrier liquid at said contact temperature said oxidation producing carbon dioxide, water and oxidation by-products;

(d) removing heat produced by said oxidation of said coke from the site of said coke by flowing carrier liquid past said oxidizing coke to provide said carrier liquid at a post-oxidation temperature;

(e) controlling the amount of said oxidizing agent to maintain said post-oxidation temperature less than the critical temperature of said carrier liquid at local pressure conditions and to maintain said carrier liquid in substantially liquid phase; and (f) flowing said carrier liquid containing said oxidation by-products as an effluent into heat exchange contact with said influent stream of carrier liquid.

2. The method of claim 1 wherein said carrier liquid is water.

3. The method of claim 1 wherein said oxidizing agent is oxygen.

4. The method of claim 1 wherein said oxidizing agent is hydrogen peroxide.

5. The method of claim 1 wherein said amount of said oxidizing agent is controlled so that said post-oxidation temperature of said carrier liquid is less than about 100° C. greater than said contact temperature.

6. The method of claim 1 wherein the amount of said oxidizing agent is controlled to maintain localized increases in surface temperatures in said reactor below about 50° C.

7. The method of claim 3 wherein said carrier liquid is water and said contacting temperature is at least about 250° C.

8. The method of claim 1 wherein said oxidizing agent is hydrogen peroxide and said carrier liquid is water and wherein the amount of said hydrogen peroxide in said water is controlled to maintain the post-oxidation temperature of said water within 100° C. of said contact temperature.

9. The method of claim 8 wherein said post-oxidation temperature is within about 50° C. of said contact temperature.

10. The method of claim 2 wherein said oxidizing agent is oxygen and the amount of said oxygen in said water is controlled by:

(a) introducing a mixture of oxygen and an inert second gas into said carrier liquid at not less than a first flow rate, said mixture having a first molar ratio of said oxygen to said second gas; and (b) changing the relative flow rates of said oxygen and said second gas to produce a mixture having a second molar ratio different from said first molar ratio at said first flow rate.

11. The method of claim 1 further comprising controlling the pH of said liquid to prevent degradation of the surfaces in the reactor by maintaining said pH between about 5 and about 11 by adding a mineral base to said carrier liquid.

12. The method of claim 1 wherein said superatmospheric pressure is between about 1000 psi and 4000 psi.

13. The method of claim 1 wherein the concentration of said carbon dioxide is measured and said method is terminated when said concentration falls below a preselected level.

14. The method of claim 1 wherein the pressure of said carrier stream is monitored downstream of said coke oxidation and the amount of said oxidizing agent is controlled to minimize fluctuations in said pressure.

15. The method of claim 1 wherein at least one of said influent and said effluent streams is in turbulent flow.

16. The method of claim 15 wherein said turbulent flow is vertical multiphase flow.

17. The method of claim 16 wherein both of said streams are in vertical multiphase flow.

18. The method of claim 3 wherein an oxidizable material is introduced into said carrier liquid to provide heat to the carrier liquid when said material is oxidized by said oxidizing agent.

19. The method of claim 18 wherein said oxidizable material is selected from the group consisting of methanol, whole crude, a distillate fraction of whole crude, or mixtures thereof.

20. The method of claim 1 wherein in step (e) at least about 95 volume percent of said carrier is in the liquid phase.

21. The method of claim 1 wherein said contacting temperature is between about 300° C. and about 350° C.

22. The method of claim 7 wherein said oxygen is introduced at the rate of at least about 3.0 kilograms of oxygen per kilogram of coke per 24 hours.

23. A method for removing coke from the internal surfaces of a vertical tube reactor said method comprising:

(a) passing an influent stream of carrier liquid downwardly into said reactor to form a hydrostatic column of fluid which provides increasing pressure on each volume segment of carrier liquid;

(b) increasing the temperature of said carrier liquid from a first temperature to a second temperature to provide heated carrier liquid;

(c) contacting said coke with an oxidizing agent in the presence of said heated carrier liquid at a contact temperature to effect the exothermic oxidation of said coke said contacting occurring under a super-atmospheric pressure from said hydrostatic column said pressure greater than the vapor pressure of said carrier liquid at said contact temperature said oxidation producing carbon dioxide, water and oxidation by-products;

(d) removing heat produced by said oxidation of said coke from the site of said coke by flowing carrier liquid past said oxidizing coke to provide said carrier liquid at a post-oxidation temperature;

(e) controlling the amount of said oxidizing agent to maintain said post-oxidation temperature less than the critical temperature of said carrier liquid at local pressure conditions and maintain said carrier liquid in substantially liquid phase; and (f) flowing said carrier liquid containing said oxidation by-products as an effluent upwardly into heat exchange contact with said influent stream of carrier liquid wherein at least one of said streams is in substantially vertical multiphase flow.

24. The method of claim 23 wherein said carrier liquid is water, said oxidizing agent is oxygen, said contact temperature is between about 250° C. and about 370° C., and said super-atmospheric pressure is at least about 1000 psi.

25. The method of claim 24 wherein both the influent and effluent streams are in substantially vertical multiphase flow during said heat exchange contact.

26. The method of claim 25 wherein a volatile material is introduced into said influent stream to provide said multiphase flow.

27. The method of claim 23 wherein a pH control agent is added to said influent carrier liquid.

28. The method of claim 23 wherein at least a portion of said effluent carrier liquid is recycled as influent carrier liquid.

* * * * *